US009110419B2

(12) United States Patent
Kudo et al.

(10) Patent No.: US 9,110,419 B2
(45) Date of Patent: Aug. 18, 2015

(54) IMAGE FORMING SYSTEM AND IMAGE FORMING APPARATUS

(75) Inventors: Tomoo Kudo, Koganei (JP); Chikatsu Suzuki, Hachioji (JP)

(73) Assignee: KONICA MINOLTA BUSINESS TECHNOLOGIES, INC., Tokyo (JP)

( * ) Notice: Subject to any disclaimer, the term of this patent is extended or adjusted under 35 U.S.C. 154(b) by 971 days.

(21) Appl. No.: 13/237,241

(22) Filed: Sep. 20, 2011

(65) Prior Publication Data

US 2012/0087690 A1 Apr. 12, 2012

(30) Foreign Application Priority Data

Oct. 6, 2010 (JP) ..... 2010-226195
Nov. 19, 2010 (JP) ..... 2010-258424

(51) Int. Cl.
*G03G 15/00* (2006.01)
*G03G 15/20* (2006.01)
*G03G 15/23* (2006.01)

(52) U.S. Cl.
CPC .... *G03G 15/238* (2013.01); *G03G 2215/00021* (2013.01)

(58) Field of Classification Search
CPC ..... G03G 15/6555; G03G 15/5029
USPC ..... 399/45, 82, 85, 306, 309
See application file for complete search history.

(56) References Cited

U.S. PATENT DOCUMENTS

2005/0169677 A1* 8/2005 Kaneko ..... 399/309
2008/0304091 A1 12/2008 Kobashigawa

FOREIGN PATENT DOCUMENTS

JP 8-248695 A 9/1996
JP 10-086455 A 4/1998
JP 2005-022243 A 1/2005
JP 2008-065470 A 3/2008
JP 2008-304915 A 12/2008

OTHER PUBLICATIONS

Japanese Office Action dated Mar. 4, 2014 (and English translation thereof) in counterpart Japanese Application No. 2010-226195.
Japanese Office Action dated Dec. 17, 2013 (and English translation thereof) in counterpart Japanese Application No. 2010-258424.

* cited by examiner

*Primary Examiner* — Erika J Villaluna
(74) *Attorney, Agent, or Firm* — Holtz, Holtz, Goodman & Chick PC

(57) ABSTRACT

Disclosed is a tandem-type image forming system performing single-sided printing and double-sided printing on a sheet, the image forming system including: a first image forming apparatus; and a second image forming apparatus connected with the first image forming apparatus in series, wherein when the single-sided printing is performed, either the first image forming apparatus or the second image forming apparatus performs printing on a sheet, and when the double-sided printing is performed, both the first image forming apparatus and the second image forming apparatus performs the printing on a sheet, the image forming system further including: a control section which controls a sheet-passing image forming apparatus which is either the first image forming apparatus or the second image forming apparatus, and does not perform the printing but performs sheet-passing in the single-sided printing.

36 Claims, 19 Drawing Sheets

FIG. 5

T1

| | SHEET LENGTH IN SUB-SCANNING DIRECTION < DISTANCE BETWEEN RESIST ROLLER AND FIXING ROLLER + α | SHEET LENGTH IN SUB-SCANNING DIRECTION ≥ DISTANCE BETWEEN RESIST ROLLER AND FIXING ROLLER + α |
|---|---|---|
| BASIS WEIGHT < 105 g/m$^2$ | CARRY MODE B | CARRY MODE B |
| BASIS WEIGHT ≥ 105 g/m$^2$ | CARRY MODE B | CARRY MODE A |

FIG. 6

T2

| | CARRY MODE A | CARRY MODE B |
|---|---|---|
| RESIST ROLLER | ROTATE | ROTATE |
| FIXING ROLLER | ROTATE | ROTATE |
| PHOTOSENSITIVE DRUM | STOP | STOP |
| INTERMEDIATE TRANSFER BELT | STOP | ROTATE |
| SECONDARY TRANSFER ROLLER | STOP (MAY ROTATE) | ROTATE |
| PHOTOSENSITIVE DRUM AND INTERMEDIATE TRANSFER BELT | SEPARATE | SEPARATE |
| INTERMEDIATE TRANSFER BELT AND SECONDARY TRANSFER ROLLER | SEPARATE | CONTACT |
| INTERMEDIATE TRANSFER BELT AND BLADE | — | SEPARATE |
| SECONDARY TRANSFER ROLLER AND BLADE | — (SEPARATE WHEN SECONDARY TRANSFER ROLLER ROTATE) | SEPARATE |

FIG.10

T3

| | SHEET LENGTH IN SUB-SCANNING DIRECTION < DISTANCE BETWEEN RESIST ROLLER AND FIXING ROLLER + α | SHEET LENGTH IN SUB-SCANNING DIRECTION ≥ DISTANCE BETWEEN RESIST ROLLER AND FIXING ROLLER + α |
|---|---|---|
| BASIS WEIGHT < 105 g/m$^2$ | PRINT MODE | PRINT MODE |
| BASIS WEIGHT ≥ 105 g/m$^2$ | PRINT MODE | CARRY MODE |

FIG. 11

T4

| | CARRY MODE | PRINT MODE |
|---|---|---|
| RESIST ROLLER | ROTATE | ROTATE |
| FIXING ROLLER | ROTATE | ROTATE |
| PHOTOSENSITIVE DRUM | STOP | ROTATE |
| TRANSFER-SEPARATION DEVICE | OFF | ON |

IMAGE FORMING SYSTEM AND IMAGE FORMING APPARATUS

BACKGROUND OF THE INVENTION

1. Field of the Invention

The present invention relates to an image forming system and an image forming apparatus.

2. Description of the Related Art

Conventionally, there is known a tandem-type image forming system in which two image forming apparatuses are connected in series. According to the tandem-type image forming system, in double-sided printing, for example, the first image forming apparatus performs printing on the front side of a sheet, and the second image forming apparatus performs printing on the backside of the sheet. Since the first image forming apparatus and the second image forming apparatus partially take responsibility in double-sided printing, as compared with an image forming system in which one image forming apparatus performs double-sided printing alone, the productivity can be increased. In general, such a tandem-type image forming system is applied to a PP (Production Print) machine which pursues high productivity.

Japanese Patent Application Laid-open Publication No. 2005-22243 discloses that, in an image forming system in which two image forming apparatus are connected in series, a paper ejection apparatus is provided between the first image forming apparatus and the second image forming apparatus. By providing the paper ejection apparatus between the two image forming apparatuses, sheets can be ejected to their respective destinations depending on which of double-sided printing and single-sided printing is performed on each of the sheets. Accordingly, the sheets undergoing double-sided printing and the sheets undergoing single-sided printing are not ejected to one paper ejection tray so as to be mixed therein.

Furthermore, Japanese Patent Application Laid-open Publication No. hei 10-86455 discloses that, in an image forming system in which two image forming apparatus are connected in series, a sheet bypass or an escape path (sheet storage path) is provided in the second image forming apparatus. By providing the sheet bypass, sheets can be carried at high speed in single-sided printing. In addition, by providing the sheet storage path, when the first image forming apparatus is broken or a jam occurs therein, the second image forming apparatus can continue printing in such a way that the order of documents is not changed from their original order.

Here, a case is examined, the case where single-sided printing is performed in a tandem-type image forming system, and the first image forming apparatus thereof performs single-sided printing.

According to Japanese Patent Application Laid-open Publication No. 2005-22243, the sheets on which single-sided printing is performed by the first image forming apparatus are ejected to the paper ejection apparatus provided between the first image forming apparatus and the second image forming apparatus. Consequently, it is not necessary to drive the second image forming apparatus. Accordingly, components/materials (photosensitive drums and developing solutions) of the second image forming apparatus can be prevented from deteriorating or being consumed. However, the paper ejection apparatus is provided between the first image forming apparatus and the second image forming apparatus, and another paper ejection apparatus is provided at a downstream side of the second image forming apparatus, and hence a large space is required for the overall system.

Furthermore, according to Japanese Patent Application Laid-open Publication No. hei 10-86455, the sheets on which single-sided printing is performed by the first image forming apparatus are carried to the sheet bypass in the second image forming apparatus. Consequently, it is not necessary to drive materials (photosensitive drums and a developing device) of the second image forming apparatus. Accordingly, the materials thereof can be prevented from deteriorating. However, the sheet bypass is provided in the second image forming apparatus, and hence the costs for the second image forming apparatus increase.

That is, the tandem-type image forming systems disclosed in Japanese Patent Application Laid-open Publications No. 2005-22243 and No. hei 10-86455 raise problems of the space increase (increase in size) or the cost increase when only single-sided printing is taken into consideration. A preferable image forming system is an image forming system having a configuration to which the configuration of a conventional tandem-type image forming system is applied as a physical configuration, and which can prevent materials/components of an image forming apparatus from deteriorating, the image forming apparatus which only makes sheets pass through (sheet-passing) in single-sided printing.

The problems raised by the image forming systems disclosed in Japanese Patent Application Laid-open Publications No. 2005-22243 and No. hei 10-86455 are also problems for a tandem-type image forming apparatus in which two image forming units are connected in series.

SUMMARY OF THE INVENTION

The present invention is made in view of the circumstances, and objects of the present invention are to provide an image forming system and an image forming apparatus, the materials (components) of which can be prevented from deteriorating, the image forming apparatus which does not perform printing on sheets but makes sheets pass through (sheet-passing) in single-side printing.

In order to achieve at least one object described above, an aspect of the present invention is a tandem-type image forming system performing single-sided printing and double-sided printing on a sheet, the image forming system including: a first image forming apparatus; and a second image forming apparatus connected with the first image forming apparatus in series, wherein when the single-sided printing is performed, either the first image forming apparatus or the second image forming apparatus performs printing on a sheet, and when the double-sided printing is performed, both the first image forming apparatus and the second image forming apparatus performs the printing on a sheet, the image forming system further including: a control section which controls a sheet-passing image forming apparatus which is either the first image forming apparatus or the second image forming apparatus, and does not perform the printing but performs sheet-passing in the single-sided printing.

Preferably, when the single-sided printing is performed, the control section rotates a resist roller and a fixing roller of the sheet-passing image forming apparatus, and controls a component of an image forming section of the sheet-passing image forming apparatus based on a sheet condition, the image forming section which is disposed on a sheet carry path between the resist roller and the fixing roller.

Preferably, each of the first image forming apparatus and the second image forming apparatus can be switched to a color mode in which color printing is performed on the sheet and to a monochrome mode in which monochrome printing is performed on the sheet so as to be set to either the color mode or the monochrome mode, and when the single-sided printing is performed, and the sheet-passing image forming apparatus is set to the color mode, the control section switches the sheet-passing image forming apparatus to the monochrome mode so as to set the sheet-passing image forming apparatus to the monochrome mode.

BRIEF DESCRIPTION OF THE DRAWINGS

The present invention is fully understood from the detailed description given hereinbelow and the accompanying drawings, which are given by way of illustration only, and thus are not intended as limits of the present invention, wherein:

FIG. 5 is a table in which a judgment standard for using a carry mode A and a carry mode B are defined according to the first embodiment;

FIG. 6 is a table showing the state of each component in performing sheet-passing in the carry mode A and in the carry mode B according to the first embodiment;

FIG. 10 is a table in which a judgment standard for using a carry mode and a print mode are defined according to the second embodiment;

FIG. 11 is a table showing the state of each component in performing sheet-passing in the carry mode and in the print mode according to the second embodiment;

DESCRIPTION OF THE PREFERRED EMBODIMENT

An image forming system according to embodiments of the present invention is described in detail referring to the accompanying drawings. The image forming system of the embodiments is an example of the present invention, and hence the present invention is not limited to the embodiments.

First Embodiment

In a first embodiment, a case where the present invention is applied to an image forming apparatus for color printing (color image forming apparatus) is described.

Figure 1:
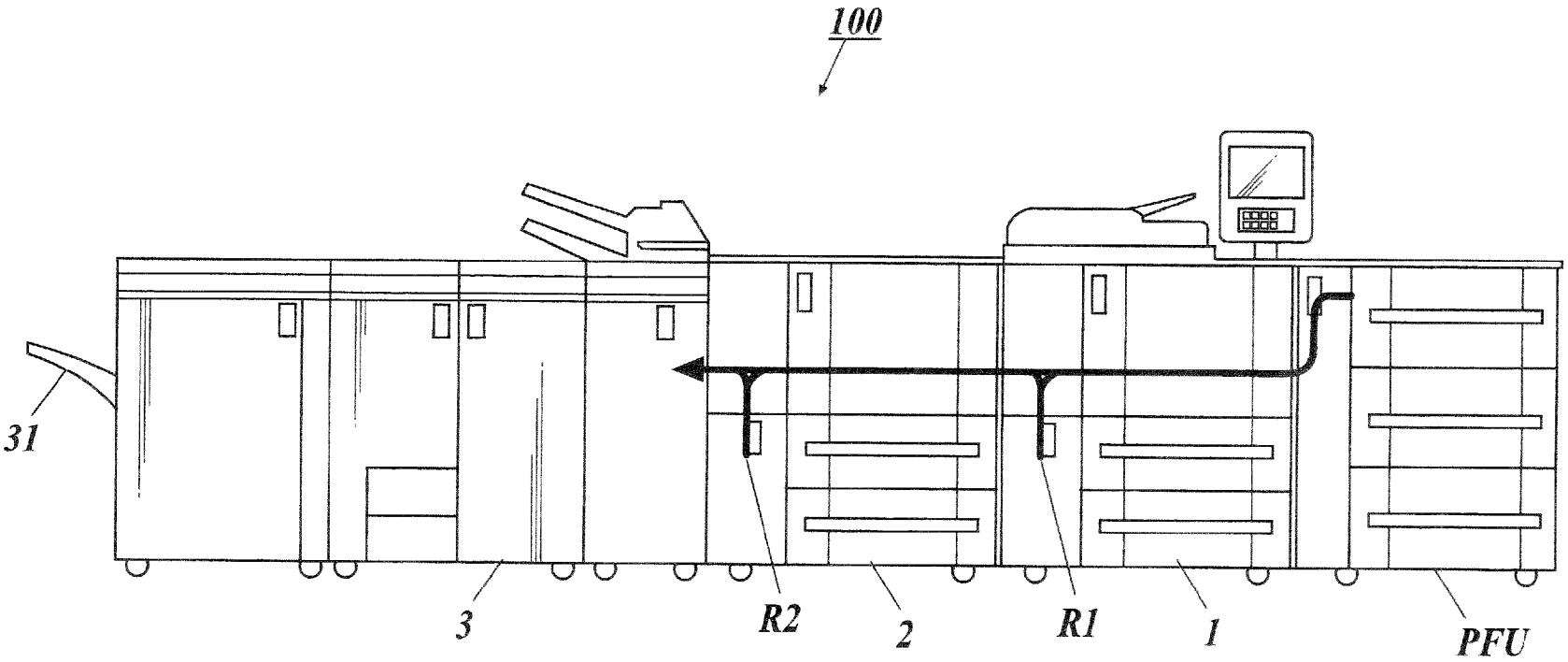
FIG. 1 shows an externally-viewed configuration of a color image forming system and a carry path for sheets of paper (a sheet carry path) therein according to a first embodiment of the present invention.

FIG. 1 shows an externally-viewed configuration of an image forming system 100 and a carry path for sheets of paper (sheet carry path) therein.

The image forming system 100 includes a paper feed unit PFU, a first image forming apparatus 1, a second image forming apparatus 2, and a finishing apparatus 3 which are connected in order. The first image forming apparatus 1 includes a reverse mechanism R1, the second image forming apparatus 2 includes a reverse mechanism R2, and the finishing apparatus 3 includes a paper ejection tray 31. An arrow in FIG. 1 indicates the sheet carry path. A system constituted of two or more image forming apparatuses connected in series such as the image forming system 100 shown in FIG. 1 is referred to as a tandem-type image forming system in general.

As shown in FIG. 1, for example, in a case of double-sided printing, the image forming system 100 makes a sheet fed from the paper feed unit PFU, and allows the first image forming apparatus 1 to perform printing on the front side of the sheet. Thereafter, the image forming system 100 allows the reverse mechanism R1 to reverse the sheet, and makes the sheet carried to the second image forming apparatus 2. Then, the image forming system 100 allows the second image forming apparatus 2 to perform printing on the back side of the sheet, allows the reverse mechanism R2 to reverse the sheet, and makes the reversed sheet carried to the finishing apparatus 3. The image forming system 100 allows the finishing apparatus 3 to perform finishing on the sheet when necessary. The finishing includes multi-folding, saddle stitching, and side stitching. At the end, the image forming system 100 makes the sheet ejected to the paper ejection tray 31, the sheet which undergoes double-sided printing or finishing.

The steps of the process described above are for the case where double-sided printing is performed. As described above, an object of the present invention is to prevent the components (materials) of an image forming apparatus from deteriorating in single-sided printing, the image forming apparatus which does not perform printing but makes a sheet pass through (sheet-passing) in single-sided printing.

Therefore, in the following, the description is made focusing on single-sided printing.

There are three cases in single-sided printing. The first case is a case where a sheet is fed from the paper feed unit PFU or a paper feed tray of the first image forming apparatus 1, and the first image forming apparatus 1 performs single-sided printing, and the second image forming apparatus 2 only performs sheet-passing. The second case is a case where a sheet is fed from the paper feed unit PFU or the paper feed tray of the first image forming apparatus 1, and the first image forming apparatus 1 does not perform single-sided printing and only performs sheet-passing, and the second image forming apparatus 2 performs single-sided printing. The third case is a case where a sheet is fed from a paper feed tray of the second image forming apparatus 2, and the second image forming apparatus 2 performs single-sided printing. Since an object of the present invention is to prevent the materials of an image forming apparatus from deteriorating, the image forming apparatus which only performs sheet-passing (sheet-passing image forming apparatus), the present invention is effective in the first case and the second case of the three cases.

As a representative of the first case, steps of a printing process are described in detail. First, the image forming system 100 makes a sheet fed from the paper feed unit PFU or the paper feed tray of the first image forming apparatus 1, and allows the first image forming apparatus 1 to perform printing on the front side of the sheet. Thereafter, the image forming system 100 makes the sheet carried to the second image forming apparatus 2. Then, the image forming system 100 allows the second image forming apparatus to perform sheet-passing on the sheet, on the front side of which the printing is performed, namely, on the sheet which undergoes single-sided printing. The image forming system 100 allows the finishing apparatus 3 to perform finishing on the sheet, reverse the sheet, or the like, the sheet which undergoes single-sided printing, when necessary. At the end, the image forming system 100 makes the sheet which undergoes single-sided printing ejected to the paper ejection tray 31.

Figure 2:
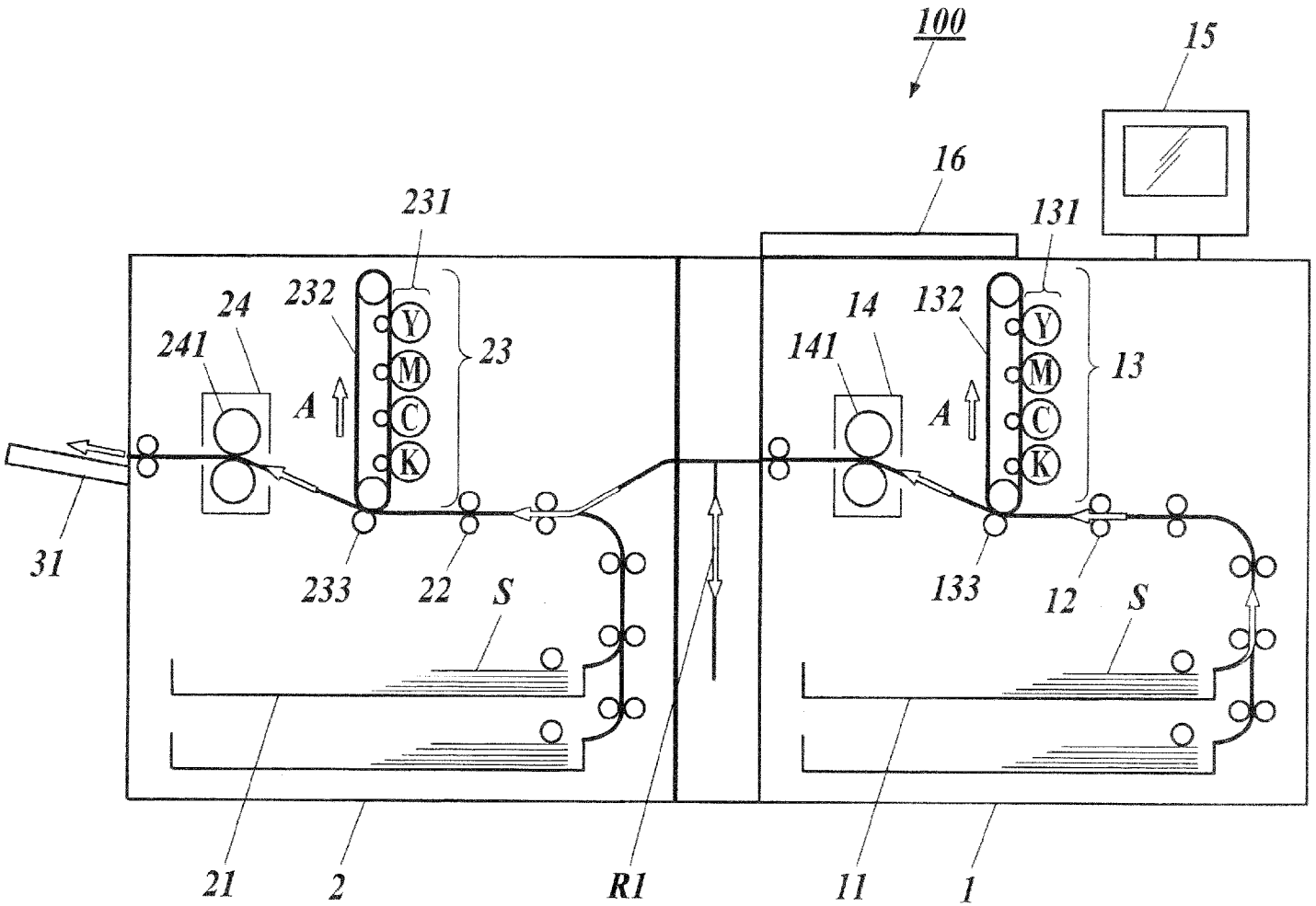
FIG. 2 shows an overall configuration and an internal configuration of the image forming system according to the first embodiment.

FIG. 2 shows an overall configuration and an internal configuration of the image forming system 100.

FIG. 2 does not show, of the image forming system 100, the paper feed unit PFU and the finishing apparatus 3 which are not directly related to the present invention. Arrows in FIG. 2 indicate the sheet carry path or a rotation direction of an intermediate transfer belt 132.

The first image forming apparatus 1 includes a paper feed section 11, resist rollers 12, an image forming section 13, a fixing section 14, an operation display section 15, a scanner 16, and the reverse mechanism R1.

The paper feed section 11 includes two paper feed trays (upper and lower paper feed trays) each of which accommodates a plurality of sheets S of paper. The paper feed section 11 accommodates the sheets S which are different in sheet type, size, or the like with the paper feed trays by dividing the sheets S by the sheet type, the size, or the like. When sheet feeding is instructed, the paper feed section 11 feeds a proper sheet S from one of the two paper feed trays, namely, the upper paper feed tray and the lower paper feed tray, and carries the sheet S to a predetermined sheet carry path.

The resist rollers 12 include rotational rollers. The resist rollers 12 are disposed at an upstream side in respect to the sheet carry path, namely, disposed upper than the image forming section 13 in respect to the sheet carry path, and very close to the image forming section 13. The resist rollers 12 carry the sheet S carried from the paper feed section 11 to the image forming section 13.

The image forming section 13 includes photosensitive drums of a Y color (yellow), an M color (magenta), a C color (cyan), and a K color (black). The image forming section 13 also includes a charger, an exposure device, a development device, a transfer device, a separator, and a cleaner (all not shown) in the vicinity of each of the Y, M, C, and K photosensitive drums. In addition, the image forming section 13 includes the intermediate transfer belt 132 which holds Y, M, C, and K toner images, and a secondary transfer roller 133 disposed in such a way as to face the intermediate transfer belt 132. The intermediate transfer belt 132 rotates in the direction indicated by an arrow A, and holds the Y, M, C, and K toner images transferred to the intermediate transfer belt 132. The secondary transfer roller 133 forms a YMCK image on the sheet S carried from the paper feed section 11 via the resist rollers 12, based on the Y, M, C, and K toner images held by the intermediate transfer belt 132. Thereafter, the image forming section 13 carries the sheet S to the fixing section 14.

The fixing section 14 includes fixing rollers 141 including a heat roller and a pressure roller. The fixing section 14 heats and pressurizes the sheet S carried from the image forming section 13 so as to fix the image on the sheet S. Then, the fixing section 14 carries the heated and pressurized sheet S with the fixing rollers 141 to a downstream side in respect to the sheet carry path, namely, lower in respect to the sheet carry path.

The operation display section 15 includes an LCD (Liquid Crystal Display), an organic EL (ElectroLuminescence) display, or the like. The operation display section 15 also includes a pressure-sensitive touch panel on the display, the touch panel in which transparent electrodes are arranged in a lattice. The operation display section 15 displays various setting screens, and receives touch operations from a user on the display.

The scanner 16 includes an automatic document feeder (ADF), a platen glass, and an optical system. The scanner 16 reads a document placed on the ADF or the platen glass with the optical system.

The second image forming apparatus 2 includes a paper feed section 21, resist rollers 22, an image forming section 23, and a fixing section 24. The operation of each of the components of the second image forming apparatus 2 is the same as that of each of the components of the first image forming apparatus 1, and hence the description thereof is not repeated.

Figure 3:
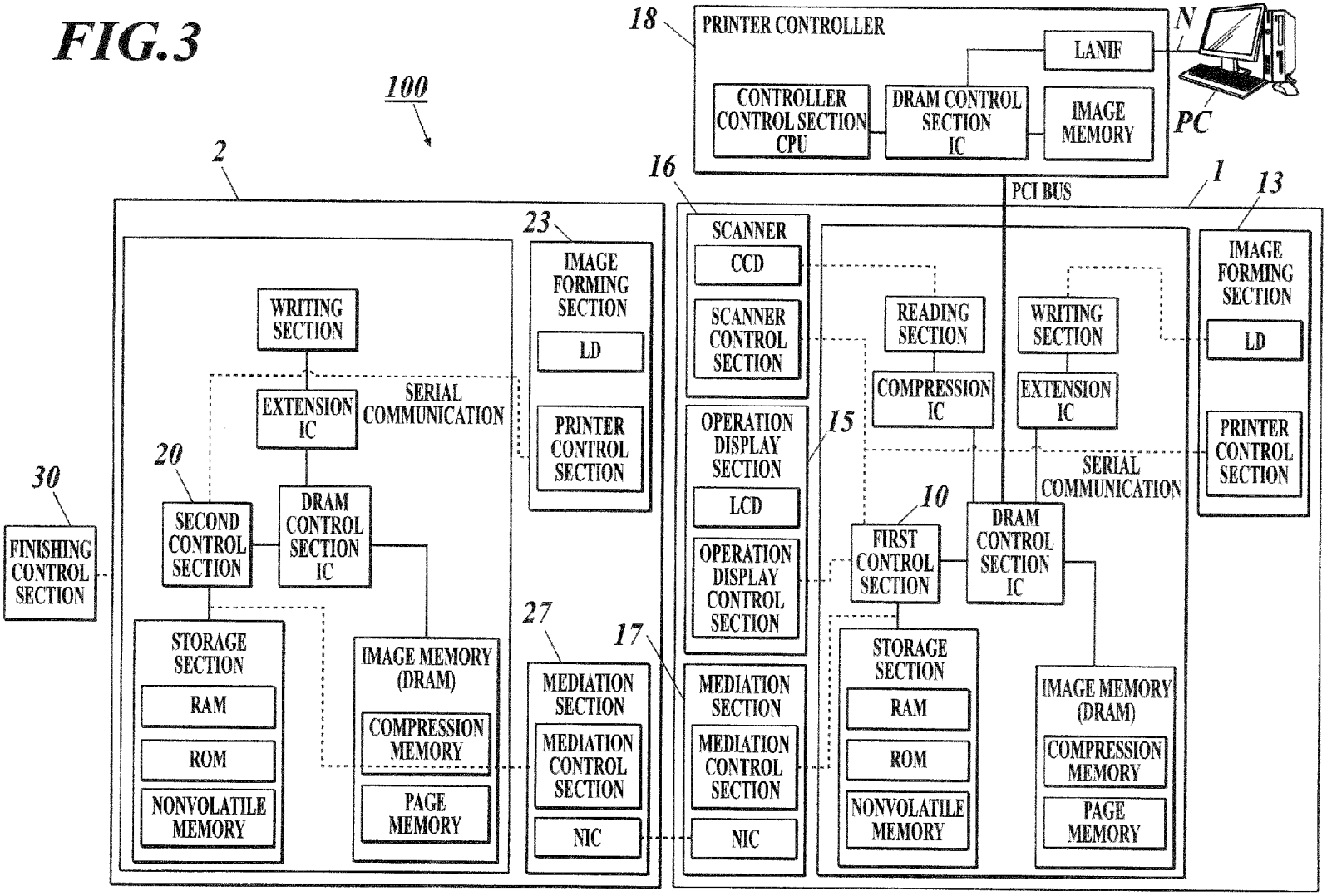
FIG. 3 is a block diagram showing a functional configuration of the image forming system according to the first embodiment.

FIG. 3 is a block diagram showing a functional configuration of the image forming system 100.

The image forming system 100 includes the first image forming apparatus 1 and the second image forming apparatus 2. FIG. 3 does not show, of the image forming system. 100, the paper feed unit PFU and the finishing apparatus 3 which are not directly related to the present invention.

The first image forming apparatus 1 includes a first control section 10, the image forming section 13, the operation display section 15, the scanner 16, a mediation section 17, and a printer controller 18.

The first control section 10 includes a CPU (Central Processing Unit), a RAM (Random Access Memory), and a ROM (Read Only Memory). The CPU expands, in the RAM, a program of various programs stored in the ROM, and controls the operations of the first image forming apparatus 1 overall by working in cooperation with the expanded program. The first control section 10 cooperates with a second control section 20 of the image forming apparatus 2 via the mediation section 17, and controls the operations of the image forming apparatus 2 overall too.

The image forming section 13 includes an LD (Laser Diode) and a printer control section. The LD receives digital image data outputted from a writing section, and forms an image on a sheet based on the received image data. The printer control section receives a control signal from the first control section 10, and controls drive of the LD and the like based on the received control signal.

The operation display section 15 includes the LCD (or organic EL display) and an operation display control section. The operation display section 15 displays various setting screens, and receives various operations from a user. When receiving an operation from a user, the operation display section 15 generates an operation signal, and outputs the generated operation signal to the first control section 10. For example, when receiving an operation which instructs printing (print command), the operation display section 15 notifies the first control section 10 of the received print command.

The scanner 16 includes a CCD (Charge Coupled Device) and a scanner control section. The scanner 16 reads a document placed on the ADF or the platen glass, thereby reading an analog image signal, and outputs the read analog image signal to a reading section.

The mediation section 17 includes a mediation control section and an NIC (Network Interface Card). The mediation section 17 allows the first image forming apparatus 1 to transmit/receive various information to/from the second image forming apparatus 2.

The printer controller 18 includes a controller control section, a DRAM (Dynamic RAM) control IC, an image memory, and a LANIF (Local Area Network Interface). The printer controller 18 receives a print job transmitted from an external terminal PC via the LANIF, performs a process with an RIP (Raster Image Processor) and the like, and outputs data which undergoes the process with the RIP to the first control section 10.

Other components thereof are as follows. The reading section receives an analog image signal from the scanner 16, and performs various processes such as an analog process, A/D conversion, and shading, and generates digital image data. The reading section outputs the generated digital image data to a compression IC.

The compression IC compresses the digital image data under the control of the DRAM control IC. Under the control of the DRAM control IC, an extension IC extends the compressed digital image data.

The DRAM control IC controls the compression and the extension onto digital image data. In addition, the DRAM control IC controls the compressed/extended digital image data so as to be inputted to/outputted from an image memory.

The image memory is constituted of a DRAM, and includes a compression memory and a page memory, and stores the compressed digital image data.

The writing section outputs the extended digital image data to the image forming section 13.

The second image forming apparatus 2 includes the second control section 20, an image forming section 23, and a mediation section 27. The operation of each of the components of the second image forming apparatus 2 is the same as that of each of the components of the first image forming apparatus 1, and hence the description thereof is not repeated.

Figure 4:
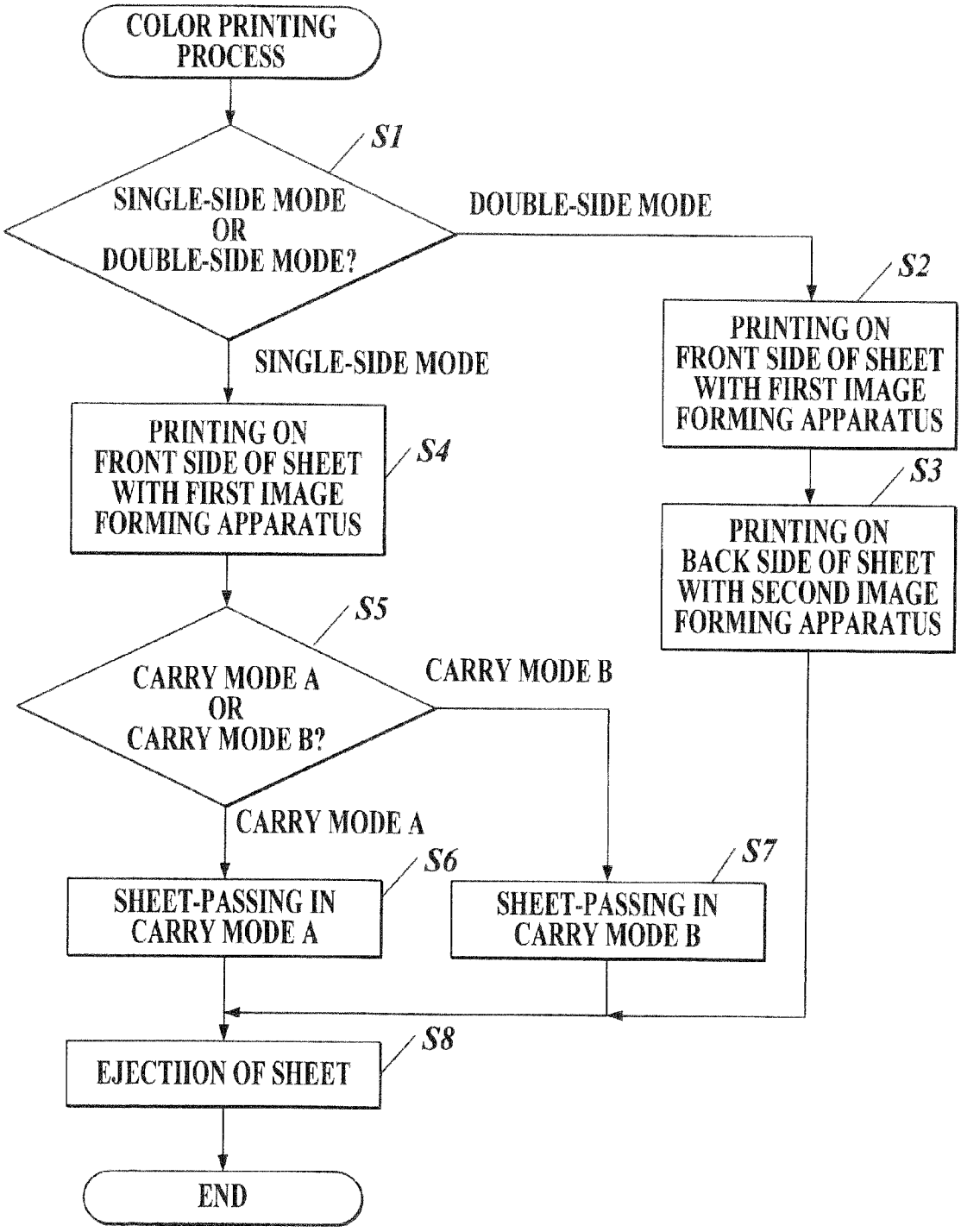
FIG. 4 is a flowchart of a color printing process according to the first embodiment.

FIG. 4 is a flowchart of a color printing process according to the first embodiment.

The flowchart of FIG. 4 shows steps of the process performed by the first control section 10. The following description is made on the assumption that the first control section 10 receives a print command from the operation display section 15, or receives a print job from the external terminal PC.

The first control section 10 judges whether to perform printing in a single-side mode or in a double-side mode in respect to the print command received from the operation display section 15 or the print job received from the external terminal PC (Step S1).

The "single-side mode" is a mode in which printing is performed only on the front side of a sheet, and the "double-side mode" is a mode in which printing is performed on the front side and the back side of a sheet.

When judging that printing is performed in the double-side mode (Step S1; double-side mode), the first control section 10 allows the first image forming apparatus 1 to perform printing on the front side of a sheet (Step S2).

Next, the first control section 10 allows the second image forming apparatus 2 to perform printing on the back side of the sheet (Step S3), and moves to Step S8.

On the other hand, when judging that printing is performed in the single-side mode (Step S1; single-side mode), the first control section 10 allows the first image forming apparatus 1 to perform printing on the front side of a sheet (Step S4).

When the first image forming apparatus 1 performs printing, the second image forming apparatus 2 does not perform printing and only makes the sheet pass through (sheet-passing).

When allowing the second image forming apparatus 2 to perform sheet-passing, the first control section 10 judges whether to perform sheet-passing in a carry mode A or in a carry mode B (Step S5).

The "carry mode A" and the "carry mode B" are predetermined, and described below in detail (FIGS. 5 to 8).

The first control section 10 allows the second image forming apparatus 2 to perform sheet-passing in the carry mode A or in the carry mode B (Step S6 or S7), which is judged at Step S5, thereby making the sheet ejected to the paper ejection tray 31 disposed at a downstream side in respect to the sheet carry path (Step S8). Then, the color printing process ends.

Referring to FIGS. 5 to 8, the "carry mode A" and the "carry mode B" are described.

FIG. 5 is a table T1 in which a judgment standard for using the carry mode A and the carry mode B are defined.

The first control section 10 refers to the table T1, and judges whether to perform sheet-passing in the carry mode A or in the carry mode B. The table T1 is stored in at least one of the storage sections shown in FIG. 3.

According to the table T1, when the length of a sheet (sheet length) in a sub-scanning direction is shorter than a distance between the resist rollers 22 and fixing rollers 241 plus a predetermined distance $\alpha$, the carry mode B is used.

When the length of a sheet in the sub-scanning direction is equal to or longer than the distance between the resist rollers 22 and the fixing rollers 241 plus the predetermined distance $\alpha$, and the basis weight of the sheet (sheet basis weight) is less than 105 g/m$^2$, the carry mode B is used.

When the length of a sheet in the sub-scanning direction is equal to or longer than the distance between the resist rollers 22 and the fixing rollers 241 plus the predetermined distance $\alpha$, and the basis weight of the sheet is equal to or more than 105 g/m$^2$, the carry mode A is used.

The table T1 uses the length and the basis weight of a sheet as a basis for the judgment on the carry mode A and the carry mode B. However, this is not a limit, and the curl amount, the temperature, the humidity, and the like of a sheet may be used therefor. For example, in a case where the curl amount of a sheet (sheet curl amount) is used as a basis for the judgment, it may be defined that the carry mode A is used when the curl amount of a sheet is less than a predetermined amount, and the carry mode B is used when the curl amount of a sheet is equal to or more than the predetermined amount.

FIG. 6 is a table T2 showing the state of each component in performing sheet-passing in the carry mode A and in the carry mode B. Since the second image forming apparatus 2 performs sheet-passing in the present embodiment, the states shown in table T2 are the states of the components of the second image forming apparatus 2.

In a case where sheet-passing is performed in the carry mode A, the resist rollers 22 and the fixing rollers 241 are driven to rotate, and components (photosensitive drums 231, an intermediate transfer belt 232, and a secondary transfer roller 233) of the image forming section 23 are not driven (stop). The fixing rollers 241 do not need to control a fixing temperature. The secondary transfer roller 233 may be driven to rotate. The photosensitive drums 231 and the intermediate transfer belt 232 are separate from each other. The intermediate transfer belt 232 and the secondary transfer roller 233 are separate from each other. Since the intermediate transfer belt 232 is not driven to rotate, a blade which removes adhesive substances adhering to the intermediate transfer belt 232 may be in contact with or be separate from the intermediate transfer belt 232. When the secondary transfer roller 233 is not driven to rotate, a blade which removes adhesive substances adhering to the secondary transfer roller 233 may be in contact with or be separate from the secondary transfer roller 233. When the secondary transfer roller 233 is driven to rotate, the blade which removes adhesive substances adhering to the secondary transfer roller 233 is separate from the secondary transfer roller 233. At the time, the blade is separate therefrom so as to be prevented from being turned up.

The case where sheet-passing is performed in the carry mode A is a case for which the conditions of a sheet (sheet conditions) are defined in the table T1 in FIG. 5. That is, it is the case where the length of a sheet in the sub-scanning direction is equal to or longer than a given distance, and the basis weight of the sheet is equal to or more than a given amount (FIG. 5). In this case, the sheet can be carried as long as the resist rollers 22 and the fixing rollers 241 are driven to rotate, and the secondary transfer roller 233 is driven to rotate supplementarily. That is, the other components, namely, the photosensitive drums 231 and the intermediate transfer belt 232, are not driven. Accordingly, the materials of the second image forming apparatus 2 which only performs sheet-passing can be prevented from deteriorating.

In a case where sheet-passing is performed in the carry mode B, the resist rollers 22, the fixing rollers 241, and the intermediate transfer belt 232 and the secondary transfer roller 233 of the image forming section 23 are driven to rotate, and only the photosensitive drums 231 of the image forming section 23 are not driven (stop). The fixing rollers 241 do not need to control a fixing temperature. The photosensitive drums 231 and the intermediate transfer belt 232 are separate from each other. The intermediate transfer belt 232 and the secondary transfer roller 233 are in contact with each other. The blade which removes adhesive substances adhering to the intermediate transfer belt 232 is separate from the intermediate transfer belt 232. The blade which removes adhesive substances adhering to the secondary transfer roller 233 is separate from the secondary transfer roller 233. The blades are respectively separate therefrom so as to be prevented from being turned up.

The case where sheet-passing is performed in the carry mode B is a case for which the sheet conditions are defined in the table T1 in FIG. 5. That is, it is the case where the length of a sheet in the sub-scanning direction is shorter than a given distance, or where the length of a sheet in the sub-scanning direction is equal to or longer than the given distance, and the basis weight of the sheet is less than a given amount (FIG. 5). In this case, the sheet cannot always be carried even when the resist rollers 22 and the fixing rollers 241 are driven to rotate, and the secondary transfer roller 233 is driven to rotate supplementarily. Therefore, the intermediate transfer belt 232 is also driven to rotate while contacting the secondary transfer roller 233. Consequently, the sheet can be carried. The other components, namely, the photosensitive drums 231 are not driven. Accordingly, the materials of the second image forming apparatus 2 which only performs sheet-passing can be prevented from deteriorating.

Figure 7:
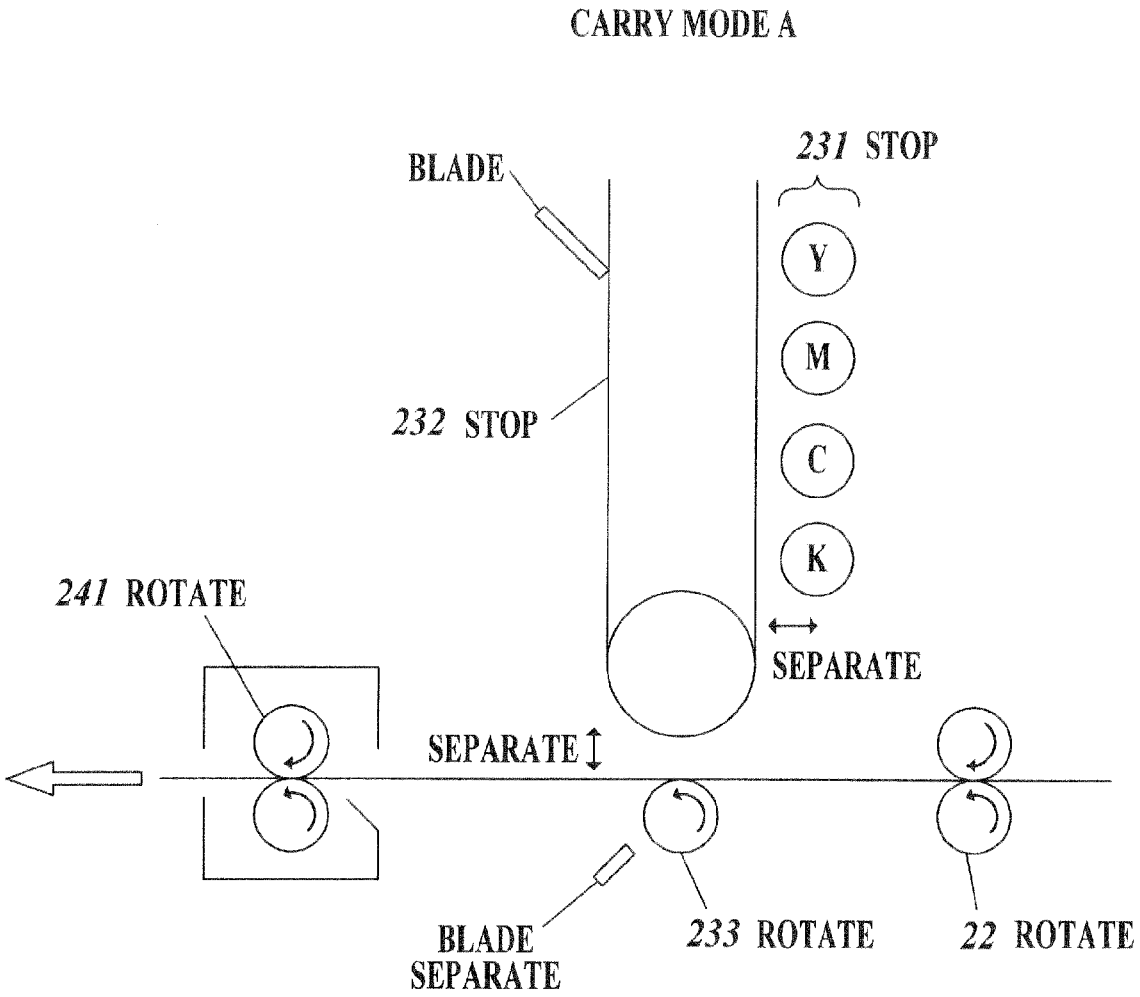
FIG. 7 shows the state of each component in performing sheet-passing in the carry mode A according to the first embodiment.

FIG. 7 shows the state of the image forming section 23 in the case where sheet-passing is performed in the carry mode A.

As shown in FIG. 7, in the carry mode A, the resist rollers 22, the fixing rollers 241, and the secondary transfer roller 233 rotate so that the sheet carried from the first image forming apparatus 1 passes through the secondary image forming apparatus 2 (sheet-passing). On the other hand, the photosensitive drums 231 and the intermediate transfer belt 232 are not driven (stop). The components (the resist rollers 22, the fixing rollers 241, and the secondary transfer roller 233) which rotate are in contact with the sheet, and the other components (the photosensitive drums 231, the intermediate transfer belt 232, and the blades) are separate from the sheet.

Figure 8:
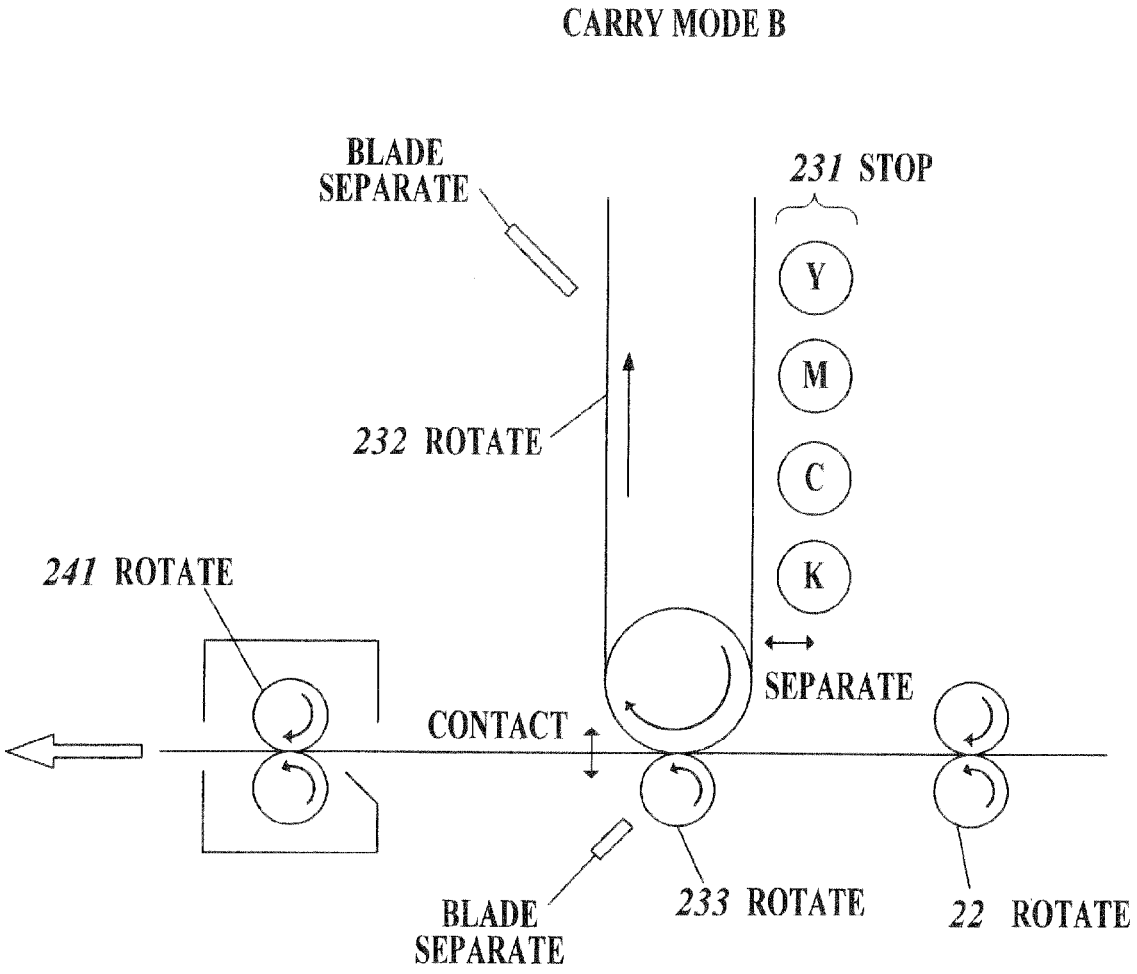
FIG. 8 shows the state of each component in performing sheet-passing in the carry mode B according to the first embodiment.

FIG. 8 shows the state of the image forming section 23 in the case where sheet-passing is performed in the carry mode B.

As shown in FIG. 8, in the carry mode B, the resist rollers 22, the fixing rollers 241, the secondary transfer roller 233, and the intermediate transfer belt 232 rotate so that the sheet carried from the first image forming apparatus 1 passes through the second image forming apparatus 2. On the other hand, the photosensitive drums 231 are not driven (stop). The components (the resist rollers 22, the fixing rollers 241, the secondary transfer roller 233, and the intermediate transfer belt 232) which rotate are in contact with the sheet, and the other components (the photosensitive drums 231 and the blades) are separate from the sheet.

The components shown in FIGS. 7 and 8 are all in contact states when printing is performed. That is, the photosensitive drums 231 are in contact with the intermediate transfer belt 232, and the blades are respectively in contact with the intermediate transfer belt 232 and the secondary transfer roller 233.

Second Embodiment

In a second embodiment, a case where the present invention is applied to an image forming apparatus for monochrome printing (monochrome image forming apparatus) is described. For convenience, the components which are the same as those described in the first embodiment are denoted by the same reference numerals.

An externally-viewed configuration of an image forming system 100 for monochrome printing and a carry path for sheets of paper (sheet carry path) therein are the same as those described referring to FIG. 1, and hence the description thereof is not repeated.

Figure 9:
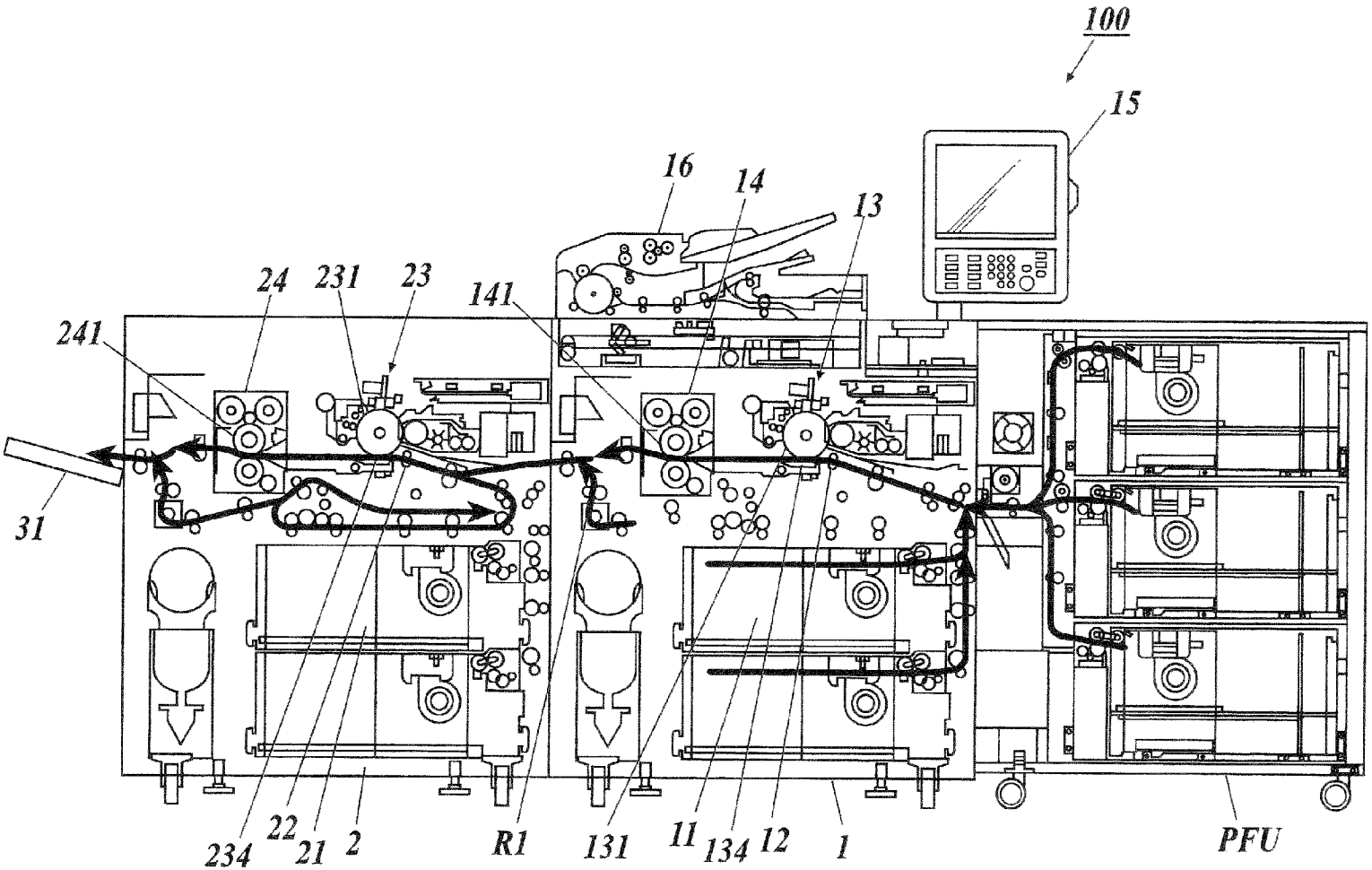
FIG. 9 shows an externally-viewed configuration of a monochrome image forming system and a carry path for sheets of paper (a sheet carry path) therein according to a second embodiment of the present invention.

FIG. 9 shows an overall configuration and an internal configuration of the image forming system 100 for monochrome printing.

FIG. 9 does not show, of the image forming system 100 for monochrome printing, a finishing apparatus 3 which is not directly related to the present invention. Arrows in FIG. 9 indicate the sheet carry path.

The first image forming apparatus 1 includes a paper feed section 11, resist rollers 12, an image forming section 13, a fixing section 14, an operation display section 15, a scanner 16, and a reverse mechanism R1. The configuration of the first image forming apparatus 1 for monochrome-printing is basically the same as the configuration of the first image forming apparatus 1 for color printing. The differences therebetween are that, in the first image forming apparatus 1 for monochrome printing, there is only one photosensitive drum. 131 of a K color (black), there is no intermediate transfer belt or secondary transfer roller, and a transfer-separation device 134 is provided instead of a secondary transfer roller, for example. The transfer-separation device 134 transfers a toner image held by the photosensitive drum 131 to a sheet which is carried to the transfer-separation device 134, and separates the photosensitive drum 131 from the sheet thereafter.

The second image forming apparatus 2 includes a paper feed section 21, resist rollers 22, an image forming section 23, and a fixing section 24. The operation of each of the components of the second image forming apparatus 2 is the same as that of each of the components of the first image forming apparatus 1, and hence the description thereof is not repeated.

A functional configuration of the image forming system 100 for monochrome printing is the same as that described referring to FIG. 3, and hence the description is not repeated.

In the following, the operation of the image forming system 100 for monochrome printing in performing single-sided printing is described referring to FIGS. 10 to 12. More specifically, the operation of the second image forming apparatus 2 in a case where the first image forming apparatus 1 performs single-sided printing, and the second image forming apparatus 2 only performs sheet-passing is described.

FIG. 10 is a table T3 in which a judgment standard for using a carry mode and a print mode are defined.

The first control section 10 refers to the table T3, and judges whether to operate the second image forming apparatus 2 in the carry mode or in the print mode. The table T3 is stored in at least one of the storage sections shown in FIG. 3.

According to the table T3, when the length of a sheet in a sub-scanning direction is shorter than a distance between the resist rollers 22 and fixing rollers 241 plus a predetermined distance $\alpha$, the print mode is used.

When the length of a sheet in the sub-scanning direction is equal to or longer than the distance between the resist rollers 22 and the fixing rollers 241 plus the predetermined distance $\alpha$, and the basis weight of the sheet is less than 105 g/m$^2$, the print mode is used.

When the length of a sheet in the sub-scanning direction is equal to or longer than the distance between the resist rollers 22 and the fixing rollers 241 plus the predetermined distance $\alpha$, and the basis weight of the sheet is equal to or more than 105 g/m$^2$, the carry mode is used.

The table T3 uses the length and the basis weight of a sheet as a basis for the judgment on the carry mode and the print mode. However, this is not a limit, and the curl amount, the temperature, the humidity, and the like of a sheet may be used therefor. For example, in a case where the curl amount of a sheet is used as a basis for the judgment, it may be defined that the carry mode is used when the curl amount of a sheet is less than a predetermined amount, and the print mode is used when the curl amount of a sheet is equal to or more than the predetermined amount.

FIG. 11 is a table T4 showing the state of each component in performing sheet-passing in the carry mode and in the print mode. Since the second image forming apparatus 2 performs sheet-passing in the present embodiment, the states shown in the table T4 are the states of the components of the second image forming apparatus 2.

In a case where sheet-passing is performed in the carry mode, the resist rollers 22 and the fixing rollers 241 are driven to rotate, and a photosensitive drum 231 of the image forming section 23 is not driven (stops). In addition, a transfer-separation device 234 of the image forming section 23 is off.

The case where sheet-passing is performed in the carry mode is a case for which the sheet conditions are defined in the table T3 in FIG. 10. That is, it is the case where the length of a sheet in the sub-scanning direction is equal to or longer than a given distance, and the basis weight of the sheet is equal to or more than a given amount (FIG. 10). In this case, the sheet can be carried as long as the resist rollers 22 and the fixing rollers 241 are driven to rotate even when the transfer-separation device 234 is off. That is, the photosensitive drum 231 is not driven. Accordingly, the material of the second image forming apparatus 2 which only performs sheet-passing can be prevented from deteriorating.

In a case where sheet-passing is performed in the print mode, the resist rollers 22, the fixing rollers 241, and the photosensitive drum 231 of the image forming section 23 are driven to rotate. In addition, the transfer-separation device 234 of the image forming section 23 is on.

The case where sheet-passing is performed in the print mode is a case for which the sheet conditions are defined in the table T3 in FIG. 10. That is, it is the case where the length of a sheet in the sub-scanning direction is shorter than the given distance, or where the length of a sheet in the sub-scanning direction is equal to or longer than the given distance, and the basis weight of the sheet is less than a given amount (FIG. 10). In this case, the sheet cannot always be carried even when the resist rollers 22, the fixing rollers 241, and the photosensitive drum 231 are driven to rotate, if the transfer-separation device 234 is off. Therefore, the transfer-separation device 234 is on. Consequently, the sheet can be carried.

Figure 12:
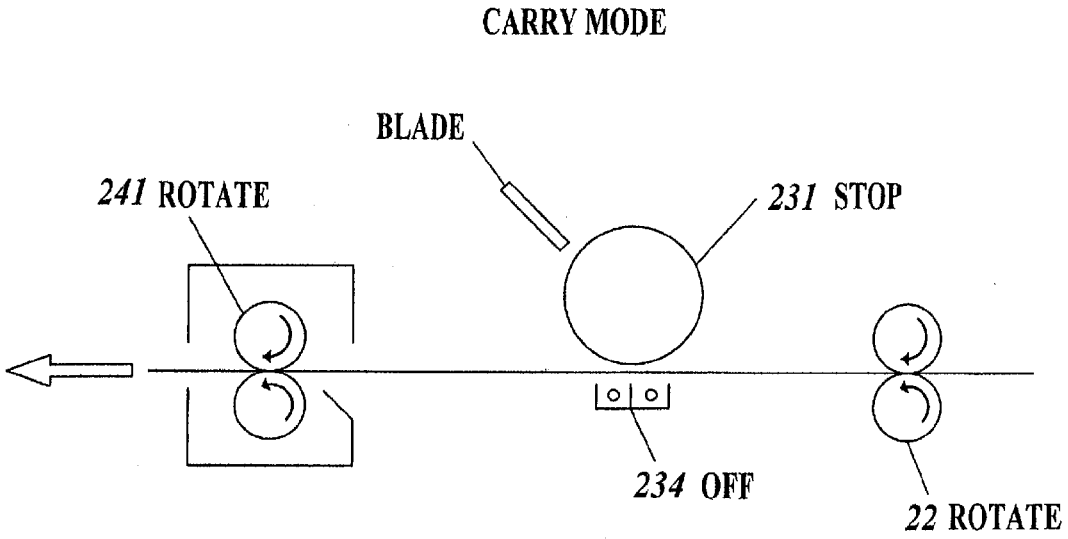
FIG. 12 shows the state of each component in performing sheet-passing in the carry mode according to the second embodiment.

FIG. 12 shows the state of the image forming section 23 in the case where sheet-passing is performed in the carry mode.

As shown in FIG. 12, in the carry mode, the resist rollers 22 and the fixing rollers 241 rotate so that the sheet carried from the first image forming apparatus 1 passes through the second image forming apparatus 2 (sheet-passing). On the other hand, the photosensitive drum 231 is not driven (stops). In addition, the transfer-separation device 234 is off.

Figure 13:
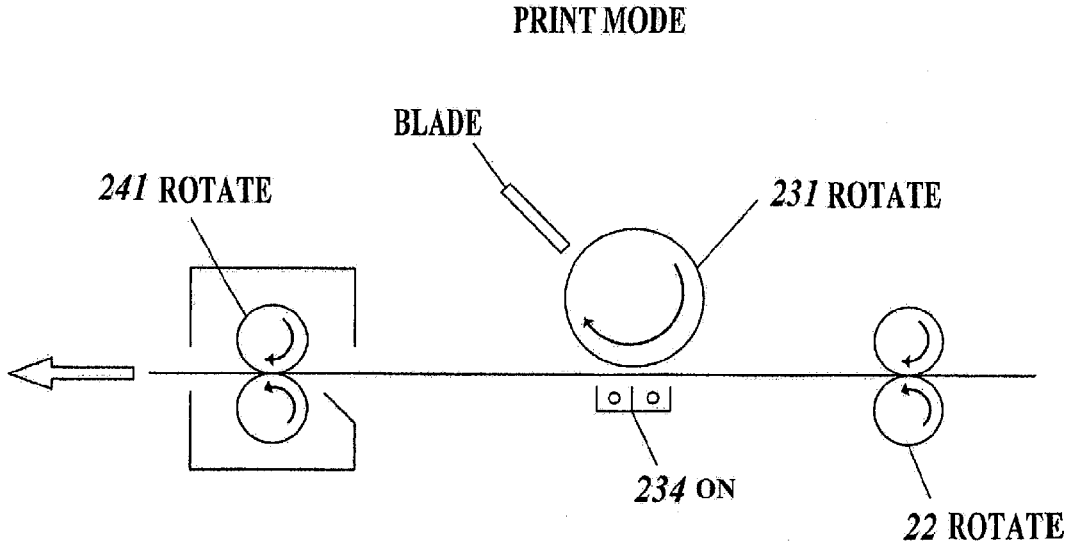
FIG. 13 shows the state of each component in performing sheet-passing in the print mode according to the second embodiment.

FIG. 13 shows the state of the image forming section 23 in the case where sheet-passing is performed in the print mode.

As shown in FIG. 13, in the print mode, the resist rollers 22, the fixing rollers 241, the secondary transfer roller 233, and the photosensitive drum 231 rotate so that the sheet carried from the first image forming apparatus 1 passes through the second image forming apparatus 2. In addition, the transfer-separation device 234 is on.

As described above, according to the first and the second embodiments, when single-sided printing is performed in the tandem-type image forming system 100, an image forming apparatus which performs only sheet-passing (sheet-passing image forming apparatus) is controlled in such a way that the resist rollers 22 and the fixing rollers 241 are driven to rotate, and hence sheet-passing can be performed. In addition, the operations of other components of the image forming apparatus can be controlled based on the sheet conditions. Accordingly, in the image forming apparatus which performs only sheet-passing, the operations of the components which are not necessary for sheet-passing can be controlled, and hence the materials thereof can be prevented from deteriorating.

According to the first embodiment, based on the sheet conditions, the control to separate the photosensitive drums 231 and the intermediate transfer belt 232 from each other, and the control to separate the intermediate transfer belt 232 and the secondary transfer roller 233 from each other can be carried out.

Furthermore, when the intermediate transfer belt 232 and the secondary transfer roller 233 are separated from each other, the control to rotate or stop the secondary transfer roller 233 can be carried out.

Furthermore, when the secondary transfer roller 233 is rotated, the control to separate the blade from the secondary transfer roller 233, the blade which is in contact with the secondary transfer roller 233, can be carried out.

Furthermore, based on the sheet conditions, the control to separate the photosensitive drums 231 and the intermediate transfer belt 232 from each other, the control to bring the intermediate transfer belt 232 and the secondary transfer roller 233 into contact with each other, and the control to rotate the intermediate transfer belt 232 and the secondary transfer roller 233 can be carried out.

Furthermore, when the intermediate transfer belt 232 is rotated, the control to separate the blade from the intermediate transfer belt 232, the blade which is in contact with the intermediate transfer belt 232, can be carried out.

According to the second embodiment, based on the sheet conditions, the control not to rotate but to stop the photosensitive drum 231, and the control to turn off the transfer-separation device 234 can be carried out.

Furthermore, based on the sheet conditions, the control to rotate the photosensitive drum 231, and the control to turn on the transfer-separation device 234 can be carried out.

Third Embodiment

In the following, an image forming apparatus according to a third embodiment is described referring to FIGS. 14 to 20.

Figure 14:
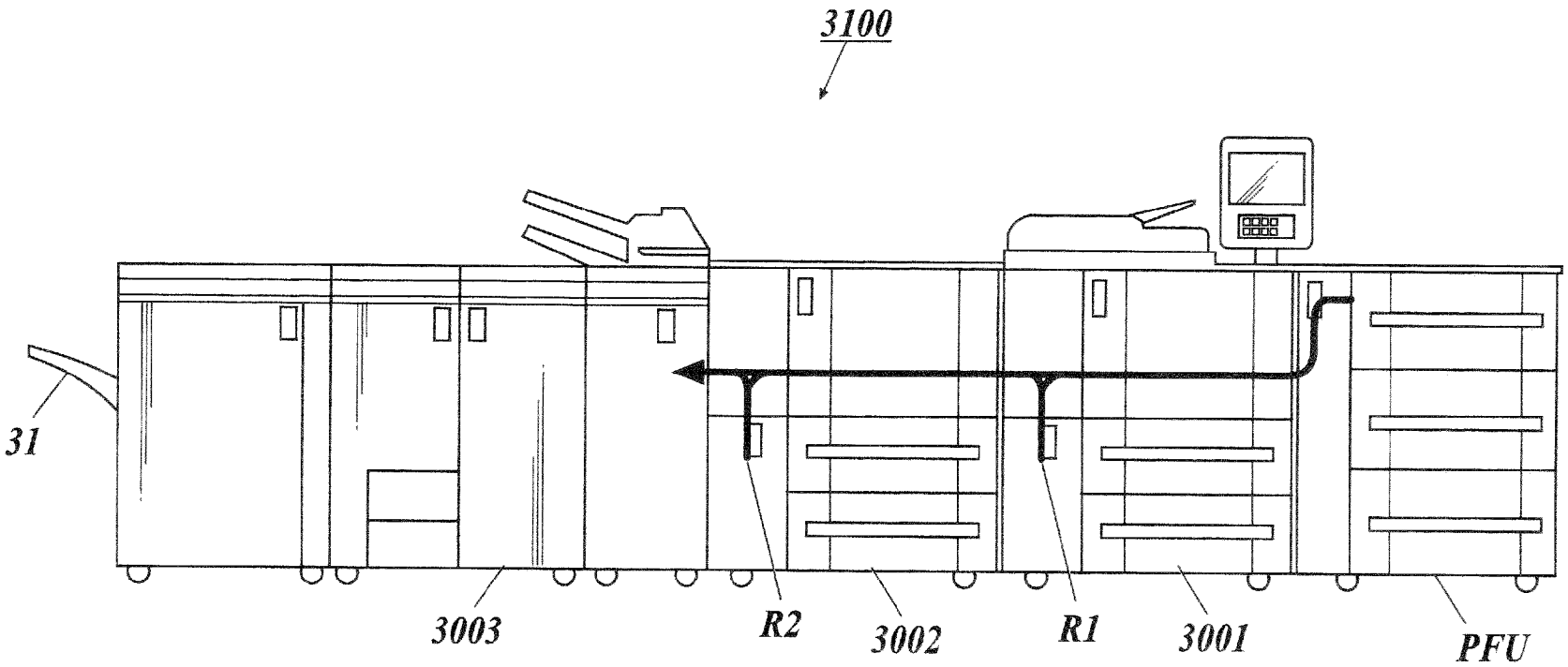
FIG. 14 shows a schematic configuration of an image forming apparatus according to a third embodiment.

As shown in FIG. 14, an image forming apparatus 3100 according to the third embodiment is a tandem-type image forming apparatus in which a paper feed unit PFU which feeds a sheet, a first image forming unit 3001 (upstream-side image forming unit) which forms an image on one side of a sheet, a second image forming unit 3002 (downstream-side image forming unit) which forms an image on one side of a sheet (the other side of the sheet), and a finishing unit 3003 which performs various finishing on a sheet are connected in series.

The first image forming unit 3001 includes a reverse mechanism R1, and the second image forming unit 3002 includes a reverse mechanism R2. The reverse mechanisms R1 and R2 are mechanisms to reverse the sides of a sheet carried by the first image forming unit 3001 and the second image forming unit 3002. The finishing unit 3003 includes a paper ejection tray 31. An arrow in FIG. 14 indicates a carry path for sheets of paper (sheet carry path).

The image forming apparatus 3100 can perform double-sided printing which is printing on both sides of a sheet, and single-sided printing which is printing on one side of a sheet.

As shown in FIG. 14, in the case of double-sided printing, the image forming apparatus 3100 makes a sheet fed from the paper feed unit PFU or a paper feed tray of the first image forming unit 3001, and allows the first image forming unit 3001 to form an image on the front side of the sheet. Thereafter, the image forming apparatus 3100 allows the reverse mechanism R1 to reverse the sheet so that the back side on which an image is not formed yet faces up, and then makes the sheet carried to the second image forming unit 3002. The image forming apparatus 3100 allows the second image forming unit 3002 to form an image on the back side of the sheet. Thereafter, the image forming apparatus 3100 allows the reverse mechanism R2 to reverse the sheet, and then makes the sheet carried to the finishing unit 3003. The image forming apparatus 3100 allows the finishing unit 3003 to perform finishing on the sheet when necessary. The finishing includes multi-folding, saddle stitching, and side stitching. At the end, the image forming system 3100 makes the sheet ejected to the paper ejection tray 31.

On the other hand, there are two cases in single-sided printing. The first case is a case where the first image forming unit 3001 performs printing on one side (front side) of a sheet (first single-sided printing). The second case is a case where the second image forming unit 3002 performs printing on one side (front side) of a sheet (second single-sided printing).

More specifically, in the case of the first single-sided printing, the image forming apparatus 3100 makes a sheet fed from the paper feed unit PFU or the paper feed tray of the first image forming unit 3001, and allows the first image forming unit 3001 to form an image on the front side of the sheet. Then, the image forming apparatus 3100 allows the second image forming unit 3002 to make the sheet pass through (sheet-passing) so that the sheet is carried to the finishing unit 3003. The image forming apparatus 3100 allows the finishing unit 3003 to perform various finishing on the sheet when necessary. At the end, the image forming apparatus 3100 makes the sheet ejected to the paper ejection tray 31.

In the case of the second single-sided printing, the image forming apparatus 3100 makes a sheet fed from the paper feed unit PFU or the paper feed tray of the first image forming unit 3001, and allows the first image forming unit 3001 to perform sheet-passing so that the sheet is carried to the second image forming unit 3002. Then, the image forming apparatus 3100 allows the second image forming unit 3002 to form an image on the front side of the sheet, and makes the sheet carried to the finishing unit 3003. The image forming apparatus 3100 allows the finishing unit 3003 to perform various finishing on the sheet when necessary. At the end, the image forming apparatus 3100 makes the sheet ejected to the paper ejection tray 31.

The image forming apparatus 3100 may be configured to make a sheet fed from the second image forming unit 3002 when the second single-sided printing is performed and the second image forming unit 3002 has a paper feed tray. However, in the image forming apparatus 3100 according to the third embodiment, in the case of the second single-sided printing, a sheet is fed from the paper feed unit PFU or the paper feed tray of the first image forming unit 3001 as described above.

Figure 15:
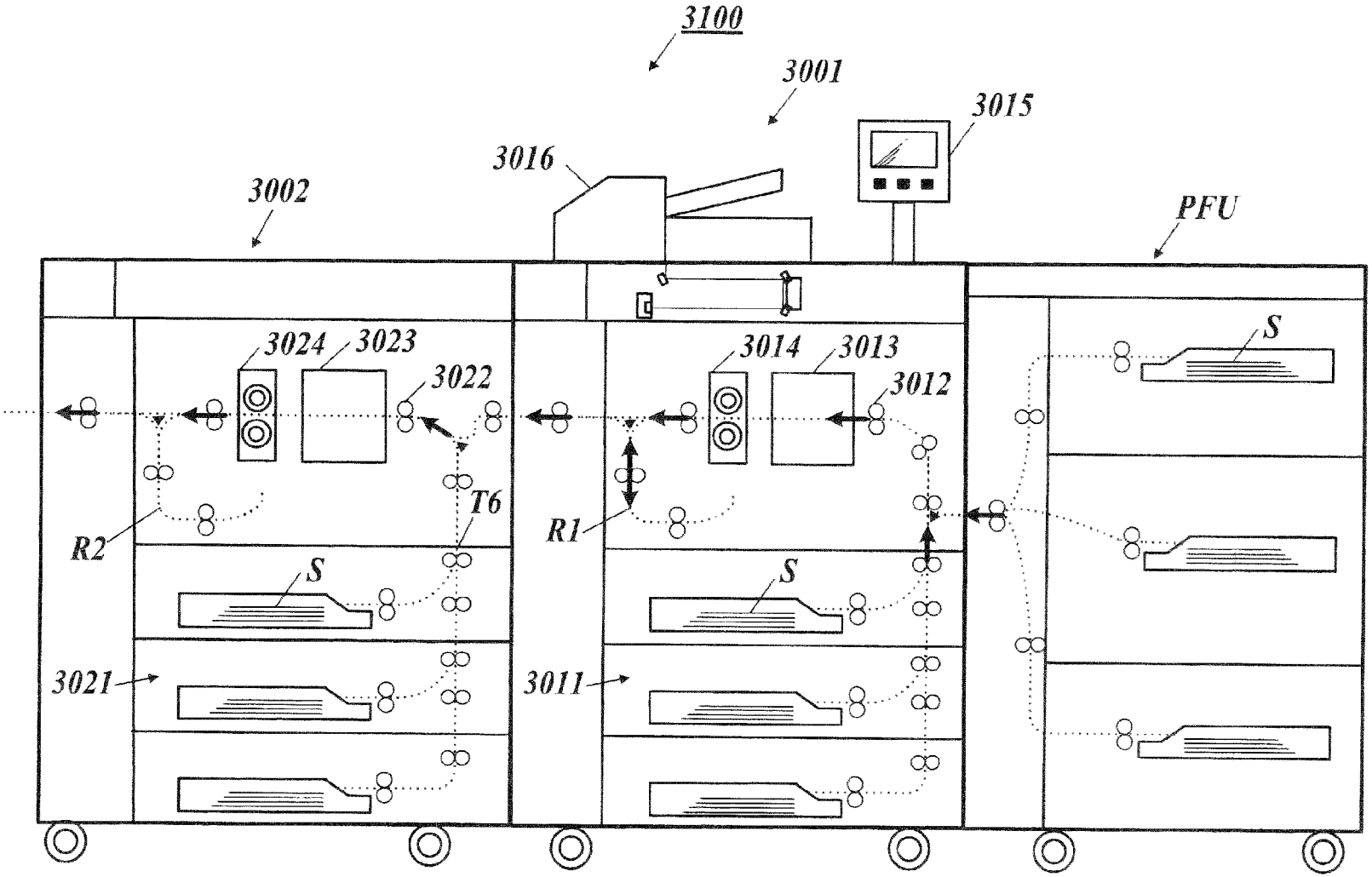
FIG. 15 shows internal configurations of a first image forming unit, a second image forming unit, and a paper feed unit of the image forming apparatus shown in FIG. 14 according to the third embodiment.
Figure 16:
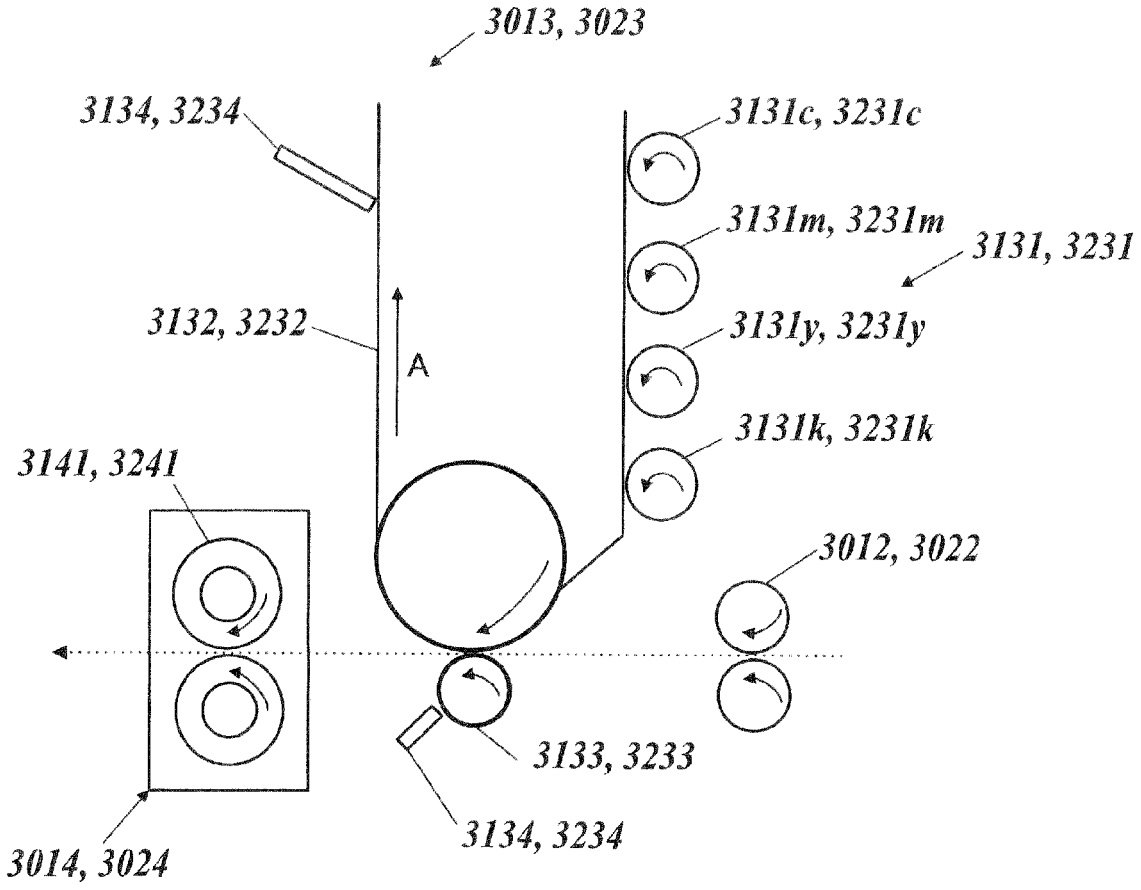
FIG. 16 schematically shows the state of an image forming section of each of the first image forming unit and the second image forming unit shown in FIG. 15, when the image forming section is set to a color mode.

Next, internal configurations of the first image forming unit 3001 and the second image forming unit 3002 are described referring to FIGS. 15 and 16. FIG. 15 does not show the finishing unit 3003 of the image forming apparatus 3100. Arrows shown in FIG. 15 indicate the carry direction of sheets S of paper (sheet carry direction of the sheet carry path).

The first image forming unit 3001 includes a paper feed section 3011, resist rollers 3012, an image forming section 3013, a fixing section 3014, an operation display section 3015, a scanner 3016, and the reverse mechanism R1.

The paper feed section 3011 includes a plurality of paper feed trays which accommodates the sheets S of paper. The sheets S divided based the weight, the size, or the like thereof are accommodated by their respective proper paper feed trays of the paper feed section 3011. Which paper feed tray accommodates which sheet S is determined by a user. Each of the sheets S accommodated by the paper feed section 3011 is carried to the resist rollers 3021 by carry rollers.

The resist rollers 3012 include rotational rollers. The resist rollers 12 are disposed at an upstream side in respect to the sheet carry direction, namely, disposed upper than the image forming section 3013 in respect to the sheet carry direction, and very close to the image forming section 3013. The resist rollers 3012 carry the sheet S carried from the paper feed section 3011 to the image forming section 3013.

As shown in FIG. 16, the image forming section 3013 includes a plurality of photosensitive drums 3131 (photosensitive drums 3131*c*, 3131*m*, 3131*y*, and 3131*k*), an intermediate transfer belt 3132 which holds toner images, a secondary transfer roller 3133 disposed in such a way as to face the intermediate transfer belt 3132, and blades 3134 respectively disposed in the vicinity of the circumferential surface of the intermediate transfer belt 3132 and in the vicinity of the circumferential surface of the secondary transfer roller 3133. The components of the image forming section 3013 are referred to as materials of the image forming section 3013.

The photosensitive drums 3131*c*, 3131*m*, 3131*y*, and 3131*k* are photosensitive drums of a C color (cyan), an M color (magenta), a Y color (yellow), and a K color (black), respectively. The image forming section 3013 also includes a charger, an exposure device, a development device, a transfer device, a separator, and a cleaner (all not shown) in the vicinity of each of the C, M, Y, and K photosensitive drums 3131*c*, 3131*m*, 3131*y*, and 3131*k*, and generates C, M, Y, and K toner images on the circumferential surfaces of the photosensitive drums 3131*c*, 3131*m*, 3131*y*, and 3131*k*, respectively.

The intermediate transfer belt 3132 rotates in the direction indicated by an arrow A in FIG. 16, and holds the toner images transferred from the photosensitive drums 3131. The secondary transfer roller 3133 transfers the toner images held by the intermediate transfer belt 3132 to the sheet S carried via the resist rollers 3012, thereby forming an image on one side of the sheet S.

The blades 3134 removes adhering substances adhering to the intermediate transfer belt 3132 and the secondary transfer roller 3133, respectively.

The fixing section 3014 includes fixing rollers 3141 including a heat roller and a pressure roller. The fixing section 3014 heats and pressurizes the sheet S carried from the image forming section 3013 so as to fix the image on the sheet S. Then, the fixing section 3014 carries the image-fixed sheet S with the fixing rollers 3141 to a downstream side in respect to the sheet carry direction, namely, lower than the fixing rollers 3014 in respect to the sheet carry direction.

The operation display section 3015 includes an LCD, an organic EL display, or the like. The operation display section 3015 also includes a pressure-sensitive touch panel on the display, the touch panel in which transparent electrodes are arranged in a lattice. The operation display section 3015 displays various setting screens, and receives touch operations from a user on the display.

The scanner 3016 includes an ADF, a platen glass, and an optical system. The scanner 3016 reads a document placed on the ADF or the platen glass with the optical system.

The second image forming unit 3002 includes a paper feed section 3021, resist rollers 3022, an image forming section 3023, and a fixing section 3024. The image forming section 3023 includes a plurality of photosensitive drums 3231 (photosensitive drums 3231*c*, 3231*m*, 3231*y*, and 3231*k*), an intermediate transfer belt 3232 which holds toner images, a secondary transfer roller 3233 disposed in such a way as to face the intermediate transfer belt 3232, and blades 3234 respectively disposed in the vicinity of the circumferential surface of the intermediate transfer belt 3232 and in the vicinity of the circumferential surface of the secondary transfer roller 3233. The operation of each of the components of the second image forming unit 3002 is the same as that of each of the components of the first image forming unit 3001, and hence the description thereof is not repeated.

Figure 17:
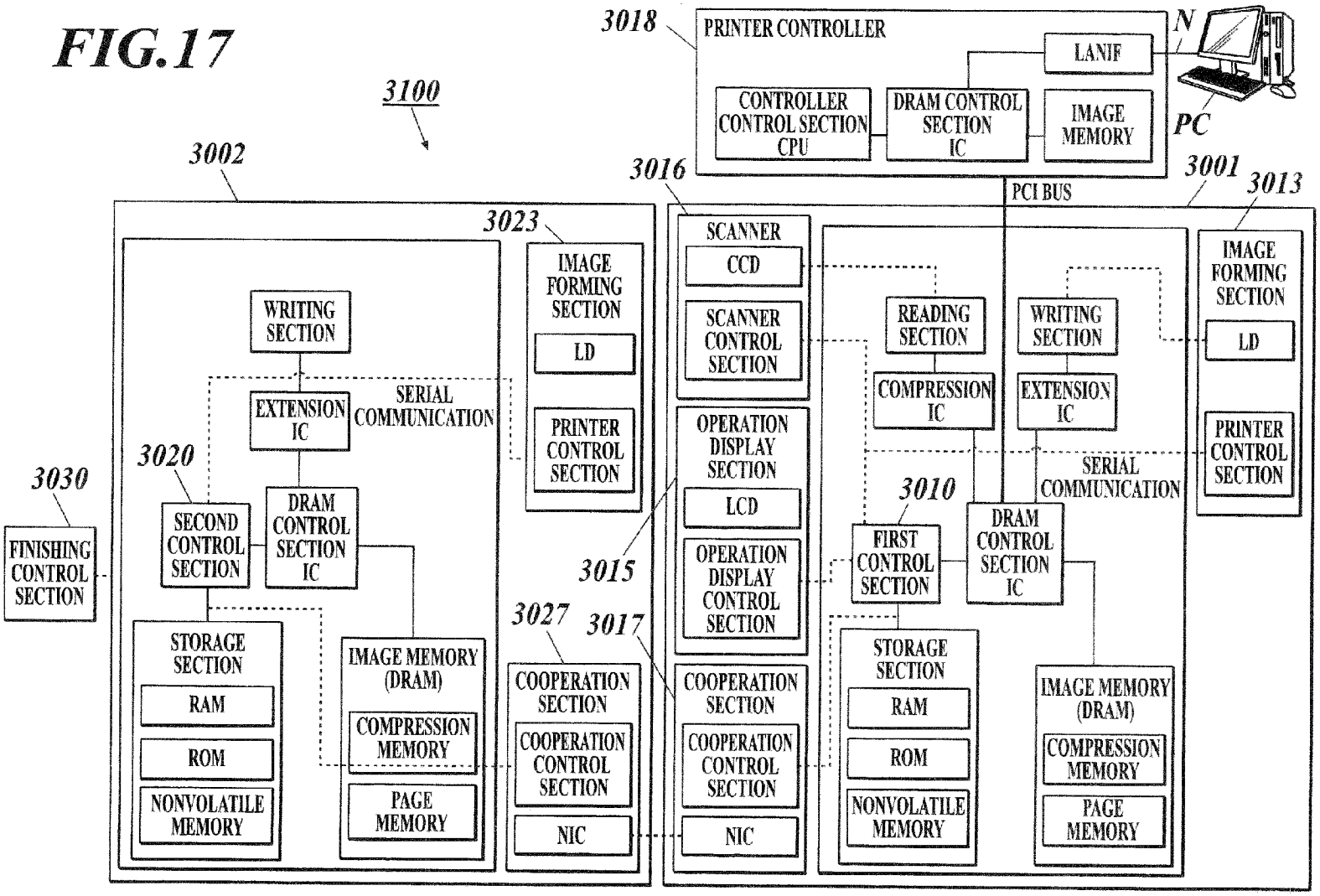
FIG. 17 is a block diagram of the image forming apparatus according to the third embodiment.

Next, a functional configuration of the image forming apparatus 3100 is described referring to FIG. 17. FIG. 17 does not show the paper feed unit PFU and the finishing unit 3003 of the image forming apparatus 3100.

The first image forming unit 3001 includes a first control section (a control section) 3010, the image forming section 3013, the operation display section 3015, the scanner 3016, a cooperation section 3017, and a printer controller 3018.

The first control section 3010 includes a CPU, a RAM, and a ROM.

The CPU expands, in the RAM, a program of various programs stored in the ROM, and controls the operations of the first image forming unit 3001 overall by working in cooperation with the expanded program. The CPU transmits a command signal to a second control section 3020 via the cooperation section 3017, thereby controlling the operations of the second image forming unit 3002 overall too. The CPU controls, for example, execution of printing in accordance with print command information (a print job transmitted from an external terminal PC or the like or an execution command to execute printing received from a user via the operation display section 3015) instructing performing printing on a predetermined number of sheets.

The RAM includes a program storage region for expanding, for example, a program executed by the CPU, and a data storage region for storing, for example, a process result obtained when a program is executed. The ROM stores a system program executable by the CPU, various process programs executable with the system program, and data used when the process programs are executed.

The image forming section 3013 includes an LD and a printer control section. The LD receives digital image data outputted from a writing section, and forms an image on a sheet based on the received image data. The printer control section receives a control signal from the first control section 3010, and controls drive of the LD and the like based on the received control signal.

The operation display section 3015 includes the LCD (or organic EL display) and an operation display control section. The operation display section 3015 displays various setting screens on the display based on command signals outputted from the first control section 3010. The operation display section 3015 also generates operation signals based on various operations received from a user via the touch panel, and outputs the generated operation signals to the first control section 3010. For example, when receiving an operation which instructs performing printing (print command) from a user, the operation display section 3015 outputs an operation signal to the first control section 3010, the operation signal which is generated based on the received print command.

The scanner 3016 includes a CCD and a scanner control section. The scanner 3016 reads a document placed on the ADF or the platen glass, thereby reading an analog image signal, and outputs the read analog image signal to a reading section.

The cooperation section 3017 includes a cooperation control section and an NIC. The cooperation section 3017 is connected to a cooperation section 3027 of the second image forming unit 3002 via the NIC, and allows the first image forming unit 3001 to transmit/receive various information to/from the second image forming unit 3002.

The printer controller 3018 includes a controller control section, a DRAM control IC, an image memory, and a LANIF. The controller control section controls the operations of the components of the printer controller 3018 overall. The DRAM control IC controls transfer of a print job received by the LANIF to the controller control section and writing/reading of image data into/from the image memory. The image memory is constituted of a DRAM and the like, and temporarily stores image data and the like.

The printer controller 3018 receives a print job transmitted from an external terminal PC via the LANIF, performs an image forming process on print data of the print job with an RIP and the like so as to generate image data, and outputs the generated image data to the first control section 3010.

Other components thereof are as follows. The reading section receives an analog image signal from the scanner 3016, and performs various processes such as an analog process, A/D conversion, and shading, and generates digital image data. The reading section outputs the generated digital image data to a compression IC. The compression IC compresses the digital image data under the control of the DRAM control IC, the digital image data which is outputted from the reading section.

Under the control of the DRAM control IC, an extension IC extends the compressed digital image data. The writing section outputs the extended digital image data, which is extended by the extension IC, to the image forming section 3013.

The DRAM control IC controls the compression and the extension onto digital image data. In addition, the DRAM control IC controls the compressed/extended digital image data so as to be inputted to/outputted from the image memory.

The image memory is constituted of a DRAM, and includes a compression memory and a page memory, and stores the compressed image data, which is compressed by the compression IC.

The second image forming unit 3002 includes the second control section 3020, an image forming section 3023, and the cooperation section 3027. The configurations of the second control section 3020, the image forming section 3023, and the cooperation section 3027 are the same as those of the first control section 3010, the image forming section 3013, and the cooperation section 3017, and hence the description thereof is not repeated.

[Mode Switching and Setting Process]

Next, a mode switching and setting process performed by the first control section 3010 is described. The mode switching and setting process is a process by which the first control section 3010 switches each image forming unit (the first image forming unit 3001/the second image forming unit 3002) to a color mode or to a monochrome mode so as to set the image forming unit to one of them. The color mode and the monochrome mode are print modes to which each image forming unit is set. The color mode is a mode in which an image forming unit performs color printing on one side of a sheet, and the monochrome mode is a mode in which an image forming unit performs monochrome printing on one side of a sheet.

For example, when setting the first image forming unit 3001 to the color mode, as shown in FIG. 16, the first control section 3010 carries out a control to bring the intermediate transfer belt 3132 and the circumferential surfaces of the C, M, Y, and K photosensitive drums 3131*c*, 3131*m*, 3131*y*, and 3131*k* into contact with each other. Then, the first control section 3010 generates C, M, Y, and K toner images on the circumferential surfaces of the C, M, Y, and K photosensitive drums 3131*c*, 3131*m*, 3131*y*, and 3131*k*, respectively, based on image data inputted into the image forming section 3013, and transfers the toner images to the intermediate transfer belt 3132. Consequently, the toner images held by the intermediate transfer belt 3132 are transferred to the secondary transfer roller 3133, and hence a color image is formed on one side of a sheet S.

Figure 18:
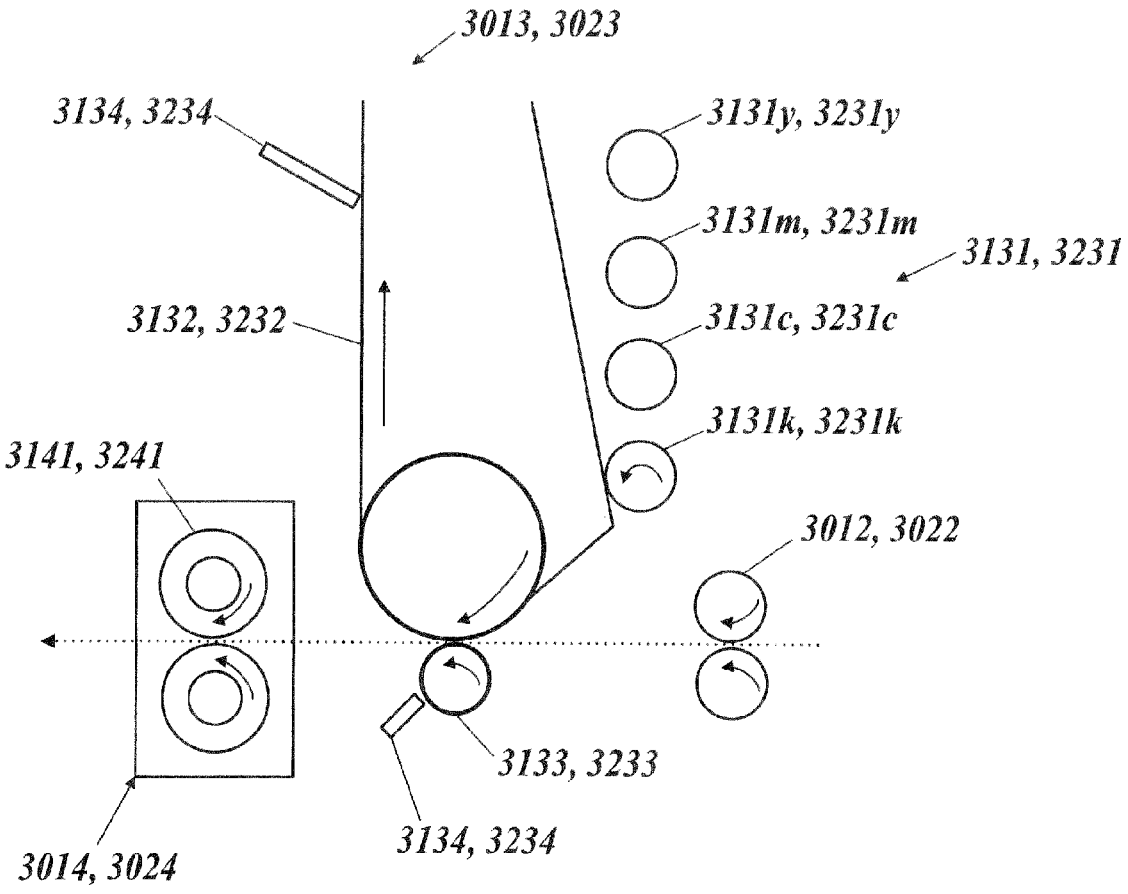
FIG. 18 schematically shows the state of the image forming section shown in FIG. 16, when the image forming section is set to a monochrome mode.

When switching the first image forming unit 3001 from the color mode to the monochrome mode so as to set the first image forming unit 3001 to the monochrome mode, as shown in FIG. 18, the first control section 3010 carries out a control to separate, among the C, M, Y, and K photosensitive drums 3131*c*, 3131*m*, 3131*y*, and 3131*k*, the C, M, and Y photosensitive drums 3131*c*, 3131*m*, and 3131*y* from the intermediate transfer belt 3132. That is, the first control section 3010 carries out a control to bring only the circumferential surface of the K photosensitive drum 3131*k* and the intermediate transfer belt 3132 into contact with each other. In addition, the first control section 3010 carries out a control to stop the charger, the exposure device, the development device, the transfer device, the separator, the cleaner, and the like which are provided for each of the C, M, and Y photosensitive drums 3131*c*, 3131*m*, and 3131*y*. Then, the first control section 3010 generates a K toner image on the circumferential surface of the K photosensitive drum 3131*k* based on image data inputted into the image forming section 3013, and transfers the toner image to the intermediate transfer belt 3132. Consequently, the toner image held by the intermediate transfer belt 3132 is transferred to the secondary transfer roller 3133, and hence a monochrome image is formed on one side of a sheet S.

On the other hand, when switching the first image forming unit 3001 from the monochrome mode to the color mode so as to set the first image forming unit 3001 to the color mode, the first control section 3010 carries out a control to bring the circumferential surfaces of the C, M, and Y photosensitive drums 3131*c*, 3131*m*, and 3131*y* and the intermediate transfer belt 3132 into contact with each other. In addition, the first control section 3010 carries out a control to drive the charger, the exposure device, the development device, the transfer device, the separator, the cleaner, and the like which are provided for each of the C, M, and Y photosensitive drums 3131*c*, 3131*m*, and 3131*y*.

When switching the second image forming unit 3002 from/to the color mode to/from the monochrome mode so as to set the second image forming unit 3002 to the monochrome mode/color mode, the first control section 3010 carries out the same controls described above via the second control section 3020.

[Single-Sided Printing Process]

Next, a single-sided printing process (single-sided printing) performed by the first control section 3010 is described.

As described above, the first control section 3010 performs the first single-sided printing, in which the first image forming unit 3010 performs printing on one side of a sheet, and the second single-sided printing, in which the second image forming unit 3002 performs printing on one side of a sheet.

In a case where the second image forming unit 3002 which does not perform printing in the first single-sided printing is set to the color mode at the time when the first single-sided printing is about to be performed, the first control section 3010 switches the second image forming unit 3002 from the color mode to the monochrome mode so as to set the second image forming unit 3002 to the monochrome mode. After the first image forming unit 3001 performs printing on one side of a sheet, the first control section 3010 allows the image forming section 3023 of the second image forming unit 3002, which is set to the monochrome mode, to form a non-color image on the sheet, namely, not to form any images on the sheet, thereby allowing the image forming section 3023 thereof to perform sheet-passing.

That is, the first control section 3010 sets the second image forming unit 3002 to the monochrome mode, the second image forming unit 3002 which does not perform printing but performs sheet-passing (sheet-passing image forming unit) in the first single-sided printing, and accordingly, prevents the materials of the image forming section 3023 from deteriorating when the image forming unit 3002 performs sheet-passing. More specifically, as compared with a case where the second image forming apparatus 3002 performs sheet-passing in a state in which the second image forming unit 3002 is set to the color mode, in a case where the second image forming unit 3002 performs sheet-passing in a state in which the second image forming unit 3002 is set to the monochrome mode, the components (C, M, and Y photosensitive drums 3131*c*, 3131*m*, and 3131*y*, and the charger, the exposure device, the development device, the transfer device, the separator, the cleaner, and the like provided for each of the photosensitive drums 3131*c*, 3131*m*, and 3131*y*) except for the components for K (black color) can be stopped, and hence the materials of the image forming section 3023 can be prevented from deteriorating.

Similarly, in a case where the first image forming unit 3001 which does not perform printing in the second single-sided printing is set to the color mode at the time when the second single-sided printing is about to be performed, the first control section 3010 switches the first image forming unit 3001 from the color mode to the monochrome mode so as to set the first image forming unit 3001 to the monochrome mode. The first control section 3010 allows the image forming section 3013 of the first image forming unit 3001, which is set to the monochrome mode, to form a non-color image on a sheet, thereby allowing the image forming section 3013 thereof to perform sheet-passing. Thereafter, the first control section 3010 allows the second image forming unit 3002 to perform printing on one side of the sheet. That is, the first control section 3010 sets the first image forming unit 3001 to the monochrome mode, the first image forming unit 3001 which does not perform printing but performs sheet-passing (sheet-passing image forming unit) in the second single-sided printing, and accordingly, prevents the materials of the image forming section 3013 from deteriorating when the first image forming unit 3001 performs sheet-passing.

When performing single-sided printing, the first control section 3010 automatically switches the first single-sided printing and the second single-sided printing based on a predetermined condition. That is, the first control section 3010 switches the image forming unit which performs printing (printing image forming unit) and the image forming unit which does not perform printing but performs sheet-passing (sheet-passing image forming unit) in the monochrome mode based thereon. The predetermined condition is, for example, the deterioration degrees of the materials of the respective image forming sections of the image forming units.

The photosensitive drums 3131 and 3231, the blades 3134 and 3234, developing solutions of the development devices, and the like of the image forming sections 3013 and 3023 are replaceable materials which are needed to be replaced on a predetermined replacement cycle. The more the replaceable materials are deteriorated, the shorter the replacement cycle becomes. Accordingly, by identifying the length of the replacement cycle based on the time measured by a timer or the like, the first control section 3010 judges the deterioration degree of the materials of each of the image forming sections 3013 and 3023.

That is, when performing single-sided printing, the first control section 3010 sets an image forming unit having the materials, the deterioration degree of which is higher (shorter replacement cycle), as an image forming unit which does not perform printing (image forming) but performs sheet-passing, and sets an image forming unit having the materials, the deterioration degree of which is lower (longer replacement cycle), as an image forming unit which performs printing (image forming). Consequently, the image forming sections of the image forming units can be uniform in deterioration progress of the materials.

However, in a case where the first control section 3010 obtains print command information from the external terminal PC or the like, and the print command information includes a command to perform single-sided printing on a sheet which is subjected to printing (target sheet) and a command to perform double-sided printing on another target sheet, the first control section 3010 does not switch the sheet-passing image forming unit to the monochrome mode even when single-sided printing is performed and the sheet-passing image forming unit is set to the color mode. This is to avoid switching the sheet-passing image forming unit from/to the color mode to/from the monochrome mode a plurality of times (for each target sheet), while single-sided printing or double-sided printing is performed on each of the target sheets indicated by the print command information. That is, when a command to perform single-sided printing and a command to perform double-sided printing exist in the print command information, taking account of the time required for switching the image forming unit from/to the color mode to/from the monochrome mode and the deterioration of the materials thereof caused by the switching operations, the first control section 3010 does not switch the sheet-passing image forming unit to the monochrome mode so that the productivity of the printing process is prevented from decreasing and the deterioration of the materials is prevented from progressing.

[Printing Process]

Figure 19:
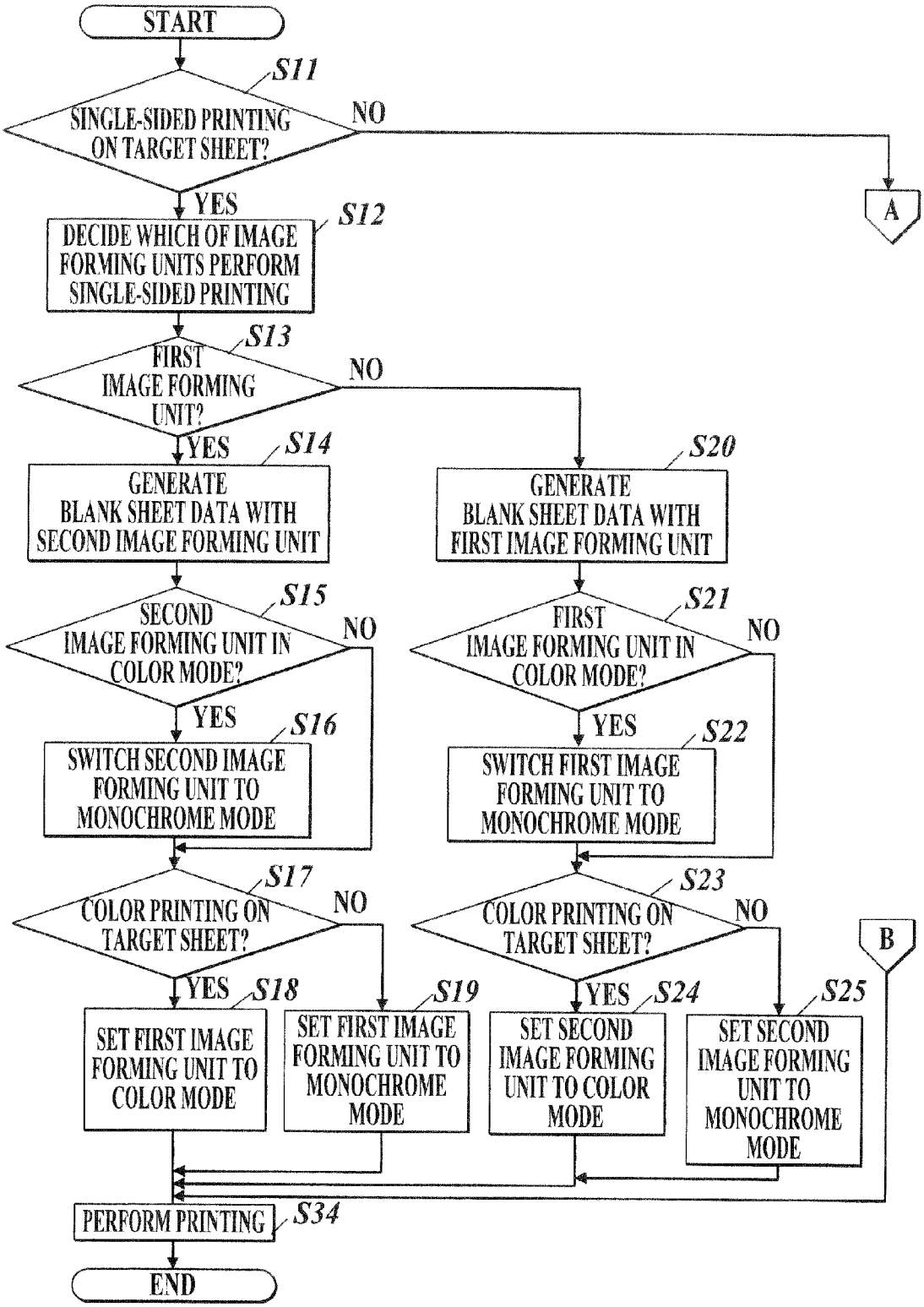
FIG. 19 is a flowchart for explaining a printing process performed by the image forming apparatus according to the third embodiment.
Figure 20:
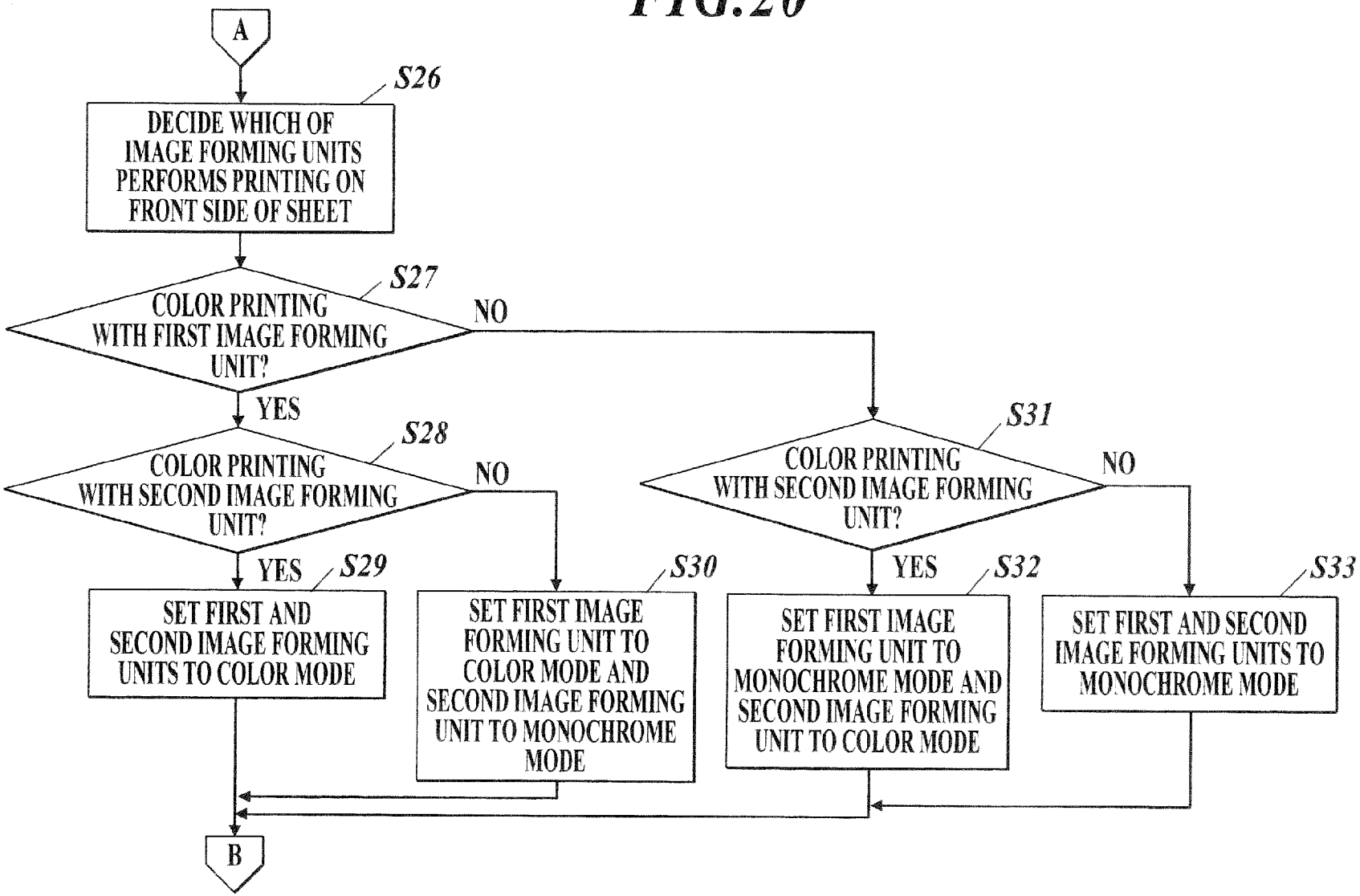
FIG. 20 is a flowchart for explaining the printing process performed by the image forming apparatus according to the third embodiment.

Next, a printing process (printing) performed by the image forming apparatus 3100 is described referring to a flowchart shown in FIGS. 19 and 20. The first control section 3010 performs steps shown in FIGS. 19 and 20 for each target sheet indicated by the obtained print command information. In the following, the description is made on the assumption that the print command information is either a command to perform single-sided printing on all the target sheets or a command to perform double-sided printing on all the target sheets. That is, the command to perform single-sided printing and the command to perform double-sided printing do not coexist in the print command information.

The first control section 3010 judges based on obtained print command information whether or not to perform single-sided printing on a target sheet (Step S11).

When judging that single-sided printing is performed at Step S11 (Step S11; YES), the first control section 3010 decides which of the first image forming unit 3001 and the second image forming unit 3002 is used as an image forming unit which performs single-sided printing (Step S12). As described above, the first control section 3010 decides the image forming unit which performs single-sided printing (automatically switches the first image forming unit 3001 and the second image forming unit 3002) based on a predetermined condition (the deterioration degree of the materials of the image forming section of each of the first image forming unit 3001 and the second image forming unit 3002).

When deciding to use the first image forming unit 3001 as the image forming unit which performs single-sided printing (namely, to perform the first single-sided printing) at Step S12 (Step S13: YES), the first control section 3010 allows the second image forming unit 3002 to generate blank sheet data (non-color image) so as to perform sheet-passing (Step S14).

Then, the first control section 3010 judges whether the second image forming unit 3002 is set to the color mode or not (Step S15).

When judging that the second image forming unit 3002 is not set to the color mode (namely, set to the monochrome mode) at Step S15 (Step S15; NO), the first control section 3010 moves to Step S17.

On the other hand, when judging that the second image forming unit 3002 is set to the color mode (Step S15; YES), the first control section 3010 switches the second image forming unit 3002 to the monochrome mode (Step S16).

Next, the first control section 3010 judges based on the print command information whether or not to perform color printing on the target sheet (Step S17).

When judging that color printing is performed at Step S17 (Step S17; YES), the first control section 3010 sets the first image forming unit 3001 to the color mode (Step S18).

On the other hand, when judging that color printing is not performed (namely, monochrome printing is performed) at Step S17 (Step S17; NO), the first control section 3010 sets the first image forming unit 3001 to the monochrome mode (Step S19).

When deciding to use the second image forming unit 3002 as the image forming unit which performs single-sided printing (namely, to perform the second single-sided printing) at Step S12 (Step S13: NO), the first control section 3010 allows the first image forming unit 3001 to generate blank sheet data (non-color image) so as to perform sheet-passing (Step S20).

Then, the first control section 3010 judges whether the first image forming unit 3001 is set to the color mode or not (Step S21).

When judging that the first image forming unit 3001 is not set to the color mode (namely, set to the monochrome mode) at Step S21 (Step S21; NO), the first control section 3010 moves to Step S23.

On the other hand, when judging that the first image forming unit 3001 is set to the color mode (Step S21; YES), the first control section 3010 switches the first image forming unit 3001 to the monochrome mode (Step S22).

Next, the first control section 3010 judges based on the print command information whether or not to perform color printing on the target sheet (Step S23).

When judging that color printing is performed at Step S23 (Step S23; YES), the first control section 3010 sets the second image forming unit 3002 to the color mode (Step S24).

On the other hand, when judging that color printing is not performed (namely, monochrome printing is performed) at Step S23 (Step S23; NO), the first control section 3010 sets the second image forming unit 3002 to the monochrome mode (Step S25).

When judging that single-sided printing is not performed but double-sided printing is performed at Step S11 (Step S11; NO), the first control section 3010 decides which of the first image forming unit 3001 and the second image forming unit 3002 performs printing on the front side of a target sheet (Step S26).

Next, the first control section 3010 judges based on the decision made at Step S26 and the print command information whether or not to perform color printing with the first image forming unit 3001 (Step S27).

When judging that color printing is performed at Step S27 (Step S27; YES), the first control section 3010 judges based on the decision made at Step S26 and the print command information whether or not to perform color printing with the second image forming unit 3002 (Step S28).

When judging that color printing is performed at Step S28 (Step S28; YES), the first control section 3010 sets the first image forming unit 3001 and the second image forming unit 3002 to the color modes, respectively (Step S29). On the other hand, when judging that color printing is not performed (namely, monochrome printing is performed) at Step S28 (Step S28; NO), the first control section 3010 sets the first image forming unit 3001 to the color mode and the second image forming unit 3002 to the monochrome mode (Step S30).

When judging that color printing is not performed (namely, monochrome printing is performed) at Step S27 (Step S27; NO), the first control section 3010 judges based on the decision made at Step S26 and the print command information whether or not to perform color printing with the second image forming unit 3002 (Step S31).

When judging that color printing is performed at Step S31 (Step S31; YES), the first control section 3010 sets the first image forming unit 3001 to the monochrome mode and the second image forming unit 3002 to the color mode (Step S32). On the other hand, when judging that color printing is not performed (namely, monochrome printing is performed) at Step S31 (Step S31; NO), the first control section 3010 sets the first image forming unit 3001 and the second image forming unit 3002 to the monochrome modes, respectively (Step S33).

Then, the first control section 3010 performs single-sided printing (first single-sided printing/second single-sided printing) or double-sided printing based on the settings made at Steps S11 to S33 (Step S34).

As described above, according to the image forming apparatus 3100 of the third embodiment, when one of the first image forming unit 3001 and the second image forming unit 3002 performs single-sided printing, the first control section 3010 switches an image forming unit which performs sheet-passing (and does not perform printing) to the monochrome mode if the image forming unit is set to the color mode. Accordingly, as compared with a case where an image forming unit performs sheet-passing in the color mode, in a case where an image forming unit performs sheet-passing in the monochrome mode, the components except for the components for a single color can be stopped, and hence the materials of the sheet-passing image forming unit can be prevented from deteriorating. Furthermore, since components such as a paper ejection device and a sheet bypass are not added to the image forming apparatus 3100, a setting space and manufacturing costs are not increased to prevent the materials from deteriorating at the time of sheet-passing.

Accordingly, the image forming apparatus 3100 is an image forming apparatus which can prevent the materials of its image forming unit which does not perform image forming (printing) but performs sheet-passing in single-sided printing from deteriorating, and also can save/reduce the setting space and the manufacturing costs.

Furthermore, according to the image forming apparatus 3100, in single-sided printing, the first control section 3010 switches the printing image forming unit and the sheet-passing image forming unit based on a predetermined condition, one of the first image forming unit 3001 and the second image forming unit 3002 being the printing image forming unit and the other thereof being the sheet-passing image forming unit. Accordingly, the image forming apparatus 3100 can make the first image forming unit 3001 and the second image forming unit 3002 uniform in deterioration progress of the materials thereof.

Furthermore, as the predetermined condition, the first control section 3010 can use, for example, the deterioration degree of the materials (replacement cycle for replaceable materials of the image forming section) of each of the first image forming unit 3001 and the second image forming unit 3002.

Furthermore, in the third embodiment, when the command to perform single-sided printing and the command to perform double-sided printing exist in the print command information, the first control section 3010 does not switch the sheet-passing image forming unit to the monochrome mode in single-sided printing, even when the sheet passing image forming unit is set to the color mode. Accordingly, the image forming apparatus 3100 can prevent the productivity from decreasing and the deterioration of materials thereof from progressing, which occur when the sheet-passing image forming unit is switched from/to the color mode to/from the monochrome mode a plurality of times.

[Modification]

According to the image forming apparatus 3100 of the third embodiment, in single-sided printing, the first control section 3010 switches the printing image forming unit and the sheet-passing image forming unit in the monochrome mode, based on the deterioration degree of the materials of the image forming section of each of the image forming units.

However, the first control section 3010 may be configured to switch the image forming units based on the number of times each image forming unit performs single-sided printing, in a case where the number of sheets on which printing is performed instructed by the print command information is more than one.

More specifically, in the case where the number of sheets on which printing is performed instructed by the print command information is more than one, the first control section 3010 predetermines a setting value which indicates how many times (i.e. on how many sheets) each image forming unit performs single-sided printing. The first control section 3010 sets an image forming unit which has performed single-sided printing the number of times indicated by the setting value as the sheet-passing image forming unit, and sets the other image forming unit as the printing image forming unit. Accordingly, the image forming units can be made uniform in deterioration progress of the materials of their image forming sections. In addition, since the number of times the sheet-passing image forming unit forms non-color images on sheets in succession is limited, unbalanced abrasion of the blades 3134 and the like can be avoided.

The embodiments and the modification described above are preferred examples of the image forming system and the image forming apparatus of the present invention, and hence are not intended to limit the present invention.

The detailed configurations and detailed operations of the components of the image forming system and the image forming apparatus of the present invention can be appropriately modified without departing from the scope of the present invention.

For example, a configuration having the same functions as the image forming system 100 may be a configuration as an image forming system in which the paper feed unit PFU, the first image forming apparatus 1, the second image forming apparatus 2, and the finishing apparatus 3 are independently configured and connected with each other, or may be a configuration as an image forming apparatus in which the paper feed unit PFU, the first image forming apparatus 1, the second image forming apparatus 2, and the finishing apparatus 3 are integrated.

Similarly, a configuration having the same functions as the image forming apparatus 3100 may be a configuration as an image forming system in which the paper feed unit PFU, the first image forming unit 3001, the second image forming unit 3002, and the finishing unit 3003 are independently configured and connected with each other, or may be a configuration as an image forming apparatus in which the paper feed unit PFU, the first image forming unit 3001, the second image forming unit 3002, and the finishing unit 3003 are integrated.

Furthermore, in the third embodiment, in a case where the print command information includes a command to perform single-sided printing on a target sheet and a command to perform double-sided printing on another target sheet, the first control section 3010 does not switch the image forming unit to the monochrome mode, the image forming unit which does not perform printing but performs sheet-passing in single-sided printing. However, even in such a case, the first control section 3010 may switch the image forming unit which performs sheet-passing in single-sided printing (sheet-passing image forming unit) to the monochrome mode when the ratio of the sheets undergoing single-sided printing to all the sheets indicated by the print command information exceeds a predetermined value. By having such a configuration, even in the case where the command to perform single-sided printing and the command to perform double-sided printing exist in the print command information, the materials of the image forming unit which does not perform printing but performs sheet-passing can be suitably prevented from deteriorating.

A first aspect of the preferred embodiments of the present invention is a tandem-type image forming system performing single-sided printing and double-sided printing on a sheet, the image forming system including: a first image forming apparatus; and a second image forming apparatus connected with the first image forming apparatus in series, wherein when the single-sided printing is performed, either the first image forming apparatus or the second image forming apparatus performs printing on a sheet, and when the double-sided printing is performed, both the first image forming apparatus and the second image forming apparatus performs the printing on a sheet, the image forming system further including: a control section which controls a sheet-passing image forming apparatus which is either the first image forming apparatus or the second image forming apparatus, and does not perform the printing but performs sheet-passing in the single-sided printing.

Accordingly, in the image forming apparatus which performs only sheet-passing, the operations of the components which are not necessary for sheet-passing can be controlled, and hence the materials thereof can be prevented from deteriorating.

Preferably, when the single-sided printing is performed, the control section rotates a resist roller and a fixing roller of the sheet-passing image forming apparatus, and controls a component of an image forming section of the sheet-passing image forming apparatus based on a sheet condition, the image forming section which is disposed on a sheet carry path between the resist roller and the fixing roller.

Accordingly, when single-sided printing is performed in the tandem-type image forming system, an image forming apparatus which performs only sheet-passing (sheet-passing image forming apparatus) is controlled in such a way that the resist rollers and the fixing rollers are driven to rotate, and hence sheet-passing can be performed. In addition, the operations of other components of the image forming apparatus can be controlled based on the sheet conditions. Accordingly, in the image forming apparatus which performs only sheet-passing, the operations of the components which are not necessary for sheet-passing can be controlled, and hence the materials thereof can be prevented from deteriorating.

Preferably, the sheet condition includes a sheet length in a sub-scanning direction, a sheet basis weight, and a sheet curl amount, the sheet-passing image forming apparatus is a color image forming apparatus, and the component of the image forming section of the sheet-passing image forming apparatus includes yellow, magenta, cyan, and black photosensitive drums, an intermediate transfer belt, and a secondary transfer roller.

Accordingly, based on the sheet conditions, the control to separate the photosensitive drums and the intermediate transfer belt from each other, and the control to separate the intermediate transfer belt and the secondary transfer roller from each other can be carried out.

Preferably, when the sheet length in the sub-scanning direction is equal to or longer than a distance between the resist roller and the fixing roller plus a predetermined distance, and the sheet basis weight is equal to or more than a predetermined amount, the control section separates the yellow, magenta, cyan, and black photosensitive drums and the intermediate transfer belt from each other, and separates the intermediate transfer belt and the secondary transfer roller from each other.

Accordingly, based on the sheet conditions, the control to separate the photosensitive drums and the intermediate transfer belt from each other, and the control to separate the intermediate transfer belt and the secondary transfer roller from each other can be carried out.

Preferably, when the sheet curl amount is less than a predetermined amount, the control section separates the yellow, magenta, cyan, and black photosensitive drums and the intermediate transfer belt from each other, and separates the intermediate transfer belt and the secondary transfer roller from each other.

Accordingly, based on the sheet conditions, the control to separate the photosensitive drums and the intermediate transfer belt from each other, and the control to separate the intermediate transfer belt and the secondary transfer roller from each other can be carried out.

Preferably, the control section rotates the secondary transfer roller.

Accordingly, when the intermediate transfer belt and the secondary transfer roller are separated from each other, the control to rotate or stop the secondary transfer roller can be carried out.

Preferably, the control section separates the secondary transfer roller and a blade which removes an adhesive substance adhering to the secondary transfer roller from each other.

Accordingly, when the secondary transfer roller is rotated, the control to separate the blade from the secondary transfer roller, the blade which is in contact with the secondary transfer roller, can be carried out.

Preferably, when the sheet length in the sub-scanning direction is shorter than a distance between the resist roller and the fixing roller plus a predetermined distance, or when the sheet length is equal to or longer than the distance between the resist roller and the fixing roller plus the predetermined distance, and the sheet basis weight is less than a predetermined amount, the control section separates the yellow, magenta, cyan, and black photosensitive drums and the intermediate transfer belt from each other, brings the intermediate transfer belt and the secondary transfer roller into contact with each other, and rotates the intermediate transfer belt and the secondary transfer roller.

Accordingly, based on the sheet conditions, the control to separate the photosensitive drums and the intermediate transfer belt from each other, the control to bring the intermediate transfer belt and the secondary transfer roller into contact with each other, and the control to rotate the intermediate transfer belt and the secondary transfer roller can be carried out.

Preferably, when the sheet curl amount is equal to or more than a predetermined amount, the control section separates the yellow, magenta, cyan, and black photosensitive drums and the intermediate transfer belt from each other, brings the intermediate transfer belt and the secondary transfer roller into contact with each other, and rotates the intermediate transfer belt and the secondary transfer roller.

Accordingly, based on the sheet conditions, the control to separate the photosensitive drums and the intermediate transfer belt from each other, the control to bring the intermediate transfer belt and the secondary transfer roller into contact with each other, and the control to rotate the intermediate transfer belt and the secondary transfer roller can be carried out.

Preferably, the control section separates the intermediate transfer belt and a blade which removes an adhesive substance adhering to the intermediate transfer belt from each other.

Accordingly, when the intermediate transfer belt is rotated, the control to separate the blade from the intermediate transfer belt, the blade which is in contact with the intermediate transfer belt, can be carried out.

Preferably, the sheet condition includes a sheet length in a sub-scanning direction, a sheet basis weight, and a sheet curl amount, the sheet-passing image forming apparatus is a monochrome image forming apparatus, and the component of the image forming section of the sheet-passing image forming apparatus includes a photosensitive drum and a transfer-separation device.

Accordingly, based on the sheet conditions, the control not to rotate but stop the photosensitive drum and the control to turn off the transfer-separation device, or the control to rotate the photosensitive drum and the control to turn on the transfer-separation device can be carried out.

Preferably, when the sheet length in the sub-scanning direction is equal to or longer than a distance between the resist roller and the fixing roller plus a predetermined distance, and the sheet basis weight is equal to or more than a predetermined amount, the control section does not rotate but stops the photosensitive drum, and turns off the transfer-separation device.

Accordingly, based on the sheet conditions, the control not to rotate but stop the photosensitive drum, and the control to turn off the transfer-separation device can be carried out.

Preferably, when the sheet curl amount is less than a predetermined amount, the control section does not rotate but stops the photosensitive drum, and turns off the transfer-separation device.

Accordingly, based on the sheet conditions, the control not to rotate but stop the photosensitive drum, and the control to turn off the transfer-separation device can be carried out.

Preferably, when the sheet length in the sub-scanning direction is shorter than a distance between the resist roller and the fixing roller plus a predetermined distance, or when the sheet length is equal to or longer than the distance between the resist roller and the fixing roller plus the predetermined distance, and the sheet basis weight is less than a predetermined amount, the control section rotates the photosensitive drum, and turns on the transfer-separation device.

Accordingly, based on the sheet conditions, the control to rotate the photosensitive drum, and the control to turn on the transfer-separation device can be carried out.

Preferably, when the sheet curl amount is equal to or more than a predetermined amount, the control section rotates the photosensitive drum, and turns on the transfer-separation device.

Accordingly, based on the sheet conditions, the control to rotate the photosensitive drum, and the control to turn on the transfer-separation device can be carried out.

Preferably, each of the first image forming apparatus and the second image forming apparatus can be switched to a color mode in which color printing is performed on the sheet and to a monochrome mode in which monochrome printing is performed on the sheet so as to be set to either the color mode or the monochrome mode, and when the single-sided printing is performed, and the sheet-passing image forming apparatus is set to the color mode, the control section switches the sheet-passing image forming apparatus to the monochrome mode so as to set the sheet-passing image forming apparatus to the monochrome mode.

Accordingly, as compared with a case where an image forming apparatus performs sheet-passing in the color mode, in a case where an image forming apparatus performs sheet-passing in the monochrome mode, the components except for the components for a single color can be stopped, and hence the materials of the sheet-passing image forming apparatus can be prevented from deteriorating. Furthermore, since components such as a paper ejection device and a sheet bypass are not added to the image forming system, a setting space and manufacturing costs are not increased to prevent the materials from deteriorating at the time of sheet-passing. Accordingly, the image forming system is an image forming system which can prevent the materials of its image forming apparatus which does not perform image forming (printing) but performs sheet-passing in single-sided printing from deteriorating, and also can save/reduce the setting space and the manufacturing costs.

Preferably, the control section switches the sheet-passing image forming apparatus and a printing image forming apparatus based on a predetermined condition, the printing image forming apparatus which is either the first image forming apparatus or the second image forming apparatus, and performs the printing in the single-sided printing.

Accordingly, the image forming system can make the first image forming apparatus and the second image forming apparatus uniform in deterioration progress of the materials thereof.

Preferably, each of the first image forming apparatus and the second image forming apparatus includes an image forming section which forms an image on the sheet, and the predetermined condition is a deterioration degree of a material of the image forming section of each of the first image forming apparatus and the second image forming apparatus.

Accordingly, as the predetermined condition, the first control section can use, for example, the deterioration degree of the materials (replacement cycle for replaceable materials of the image forming section) of each of the first image forming apparatus and the second image forming apparatus.

Preferably, the predetermined condition is a number of times each of the first image forming apparatus and the second image forming apparatus performs the printing in the single-sided printing.

Accordingly, the image forming apparatuses can be made uniform in deterioration progress of the materials of their image forming sections. In addition, since the number of times the sheet-passing image forming apparatus forms non-color images on sheets in succession is limited, unbalanced abrasion of the blades and the like can be avoided.

Preferably, the control section performs the printing in accordance with print command information which indicates performing the printing on a certain number of sheets, and when a command to perform the single-sided printing and a command to perform the double-sided printing exist in the print command information, and the single-sided printing is performed, the control section does not switch the sheet-passing image forming apparatus to the monochrome mode even if the sheet-passing image forming apparatus is set to the color mode.

Accordingly, the image forming system can prevent the productivity from decreasing and the deterioration of materials thereof from progressing, which occur when the sheet-passing image forming apparatus is switched from/to the color mode to/from the monochrome mode a plurality of times.

A second aspect of the preferred embodiments of the present invention is a tandem-type image forming apparatus performing single-sided printing and double-sided printing on a sheet, the image forming apparatus including: a first image forming unit; and a second image forming unit connected with the first image forming unit in series, wherein when the single-sided printing is performed, either the first image forming unit or the second image forming unit performs printing on a sheet, and when the double-sided printing is performed, both the first image forming unit and the second image forming unit performs the printing on a sheet, the image forming apparatus further including: a control section which controls a sheet-passing image forming unit which is either the first image forming unit or the second image forming unit, and does not perform the printing but performs sheet-passing in the single-sided printing.

Accordingly, in the image forming unit which performs only sheet-passing, the operations of the components which are not necessary for sheet-passing can be controlled, and hence the materials thereof can be prevented from deteriorating.

Preferably, when the single-sided printing is performed, the control section rotates a resist roller and a fixing roller of the sheet-passing image forming unit, and controls a component of an image forming section of the sheet-passing image forming unit based on a sheet condition, the image forming section which is disposed on a sheet carry path between the resist roller and the fixing roller.

Accordingly, when single-sided printing is performed in the tandem-type image forming apparatus, an image forming unit which performs only sheet-passing (sheet-passing image forming apparatus) is controlled in such a way that the resist rollers and the fixing rollers are driven to rotate, and hence sheet-passing can be performed. In addition, the operations of other components of the image forming unit can be controlled based on the sheet conditions. Accordingly, in the image forming unit which performs only sheet-passing, the operations of the components which are not necessary for sheet-passing can be controlled, and hence the materials thereof can be prevented from deteriorating.

Preferably, the sheet condition includes a sheet length in a sub-scanning direction, a sheet basis weight, and a sheet curl amount, the sheet-passing image forming unit is a color image forming unit, and the component of the image forming section of the sheet-passing image forming unit includes yellow, magenta, cyan, and black photosensitive drums, an intermediate transfer belt, and a secondary transfer roller.

Accordingly, based on the sheet conditions, the control to separate the photosensitive drums and the intermediate transfer belt from each other, and the control to separate the intermediate transfer belt and the secondary transfer roller from each other can be carried out.

Preferably, when the sheet length in the sub-scanning direction is equal to or longer than a distance between the resist roller and the fixing roller plus a predetermined distance, and the sheet basis weight is equal to or more than a predetermined amount, the control section separates the yellow, magenta, cyan, and black photosensitive drums and the intermediate transfer belt from each other, and separates the intermediate transfer belt and the secondary transfer roller from each other.

Accordingly, based on the sheet conditions, the control to separate the photosensitive drums and the intermediate transfer belt from each other, and the control to separate the intermediate transfer belt and the secondary transfer roller from each other can be carried out.

Preferably, when the sheet curl amount is less than a predetermined amount, the control section separates the yellow, magenta, cyan, and black photosensitive drums and the intermediate transfer belt from each other, and separates the intermediate transfer belt and the secondary transfer roller from each other.

Accordingly, based on the sheet conditions, the control to separate the photosensitive drums and the intermediate transfer belt from each other, and the control to separate the intermediate transfer belt and the secondary transfer roller from each other can be carried out.

Preferably, the control section rotates the secondary transfer roller.

Accordingly, when the intermediate transfer belt and the secondary transfer roller are separated from each other, the control to rotate or stop the secondary transfer roller can be carried out.

Preferably, the control section separates the secondary transfer roller and a blade which removes an adhesive substance adhering to the secondary transfer roller from each other.

Accordingly, when the secondary transfer roller is rotated, the control to separate the blade from the secondary transfer roller, the blade which is in contact with the secondary transfer roller, can be carried out.

Preferably, when the sheet length in the sub-scanning direction is shorter than a distance between the resist roller and the fixing roller plus a predetermined distance, or when the sheet length is equal to or longer than the distance between the resist roller and the fixing roller plus the predetermined distance, and the sheet basis weight is less than a predetermined amount, the control section separates the yellow, magenta, cyan, and black photosensitive drums and the intermediate transfer belt from each other, brings the intermediate transfer belt and the secondary transfer roller into contact with each other, and rotates the intermediate transfer belt and the secondary transfer roller.

Accordingly, based on the sheet conditions, the control to separate the photosensitive drums and the intermediate transfer belt from each other, the control to bring the intermediate transfer belt and the secondary transfer roller into contact with each other, and the control to rotate the intermediate transfer belt and the secondary transfer roller can be carried out.

Preferably, when the sheet curl amount is equal to or more than a predetermined amount, the control section separates the yellow, magenta, cyan, and black photosensitive drums and the intermediate transfer belt from each other, brings the intermediate transfer belt and the secondary transfer roller into contact with each other, and rotates the intermediate transfer belt and the secondary transfer roller.

Accordingly, based on the sheet conditions, the control to separate the photosensitive drums and the intermediate transfer belt from each other, the control to bring the intermediate transfer belt and the secondary transfer roller into contact with each other, and the control to rotate the intermediate transfer belt and the secondary transfer roller can be carried out.

Preferably, the control section separates the intermediate transfer belt and a blade which removes an adhesive substance adhering to the intermediate transfer belt from each other.

Accordingly, when the intermediate transfer belt is rotated, the control to separate the blade from the intermediate transfer belt, the blade which is in contact with the intermediate transfer belt, can be carried out.

Preferably, the sheet condition includes a sheet length in a sub-scanning direction, a sheet basis weight, and a sheet curl amount, the sheet-passing image forming unit is a monochrome image forming unit, and the component of the image forming section of the sheet-passing image forming unit includes a photosensitive drum and a transfer-separation device.

Accordingly, based on the sheet conditions, the control not to rotate but stop the photosensitive drum and the control to turn off the transfer-separation device, or the control to rotate the photosensitive drum and the control to turn on the transfer-separation device can be carried out.

Preferably, when the sheet length in the sub-scanning direction is equal to or longer than a distance between the resist roller and the fixing roller plus a predetermined distance, and the sheet basis weight is equal to or more than a predetermined amount, the control section does not rotate but stops the photosensitive drum, and turns off the transfer-separation device.

Accordingly, based on the sheet conditions, the control not to rotate but stop the photosensitive drum, and the control to turn off the transfer-separation device can be carried out.

Preferably, when the sheet curl amount is less than a predetermined amount, the control section does not rotate but stops the photosensitive drum, and turns off the transfer-separation device.

Accordingly, based on the sheet conditions, the control not to rotate but stop the photosensitive drum, and the control to turn off the transfer-separation device can be carried out.

Preferably, when the sheet length in the sub-scanning direction is shorter than a distance between the resist roller and the fixing roller plus a predetermined distance, or when the sheet length is equal to or longer than the distance between the resist roller and the fixing roller plus the predetermined distance, and the sheet basis weight is less than a predetermined amount, the control section rotates the photosensitive drum, and turns on the transfer-separation device.

Accordingly, based on the sheet conditions, the control to rotate the photosensitive drum, and the control to turn on the transfer-separation device can be carried out.

Preferably, when the sheet curl amount is equal to or more than a predetermined amount, the control section rotates the photosensitive drum, and turns on the transfer-separation device.

Accordingly, based on the sheet conditions, the control to rotate the photosensitive drum, and the control to turn on the transfer-separation device can be carried out.

Preferably, each of the first image forming unit and the second image forming unit can be switched to a color mode in which color printing is performed on the sheet and to a monochrome mode in which monochrome printing is performed on the sheet so as to be set to either the color mode or the monochrome mode, and when the single-sided printing is performed, and the sheet-passing image forming unit is set to the color mode, the control section switches the sheet-passing image forming unit to the monochrome mode so as to set the sheet-passing image forming unit to the monochrome mode.

Accordingly, as compared with a case where an image forming unit performs sheet-passing in the color mode, in a case where an image forming unit performs sheet-passing in the monochrome mode, the components except for the components for a single color can be stopped, and hence the materials of the sheet-passing image forming unit can be prevented from deteriorating. Furthermore, since components such as a paper ejection device and a sheet bypass are not added to the image forming apparatus, a setting space and manufacturing costs are not increased to prevent the materials from deteriorating at the time of sheet-passing. Accordingly, the image forming apparatus is an image forming apparatus which can prevent the materials of its image forming unit which does not perform image forming (printing) but performs sheet-passing in single-sided printing from deteriorating, and also can save/reduce the setting space and the manufacturing costs.

Preferably, the control section switches the sheet-passing image forming unit and a printing image forming unit based on a predetermined condition, the printing image forming unit which is either the first image forming unit or the second image forming unit, and performs the printing in the single-sided printing.

Accordingly, the image forming apparatus can make the first image forming unit and the second image forming unit uniform in deterioration progress of the materials thereof.

Preferably, each of the first image forming unit and the second image forming unit includes an image forming section which forms an image on the sheet, and the predetermined condition is a deterioration degree of a material of the image forming section of each of the first image forming unit and the second image forming unit.

Accordingly, as the predetermined condition, the first control section can use, for example, the deterioration degree of the materials (replacement cycle for replaceable materials of the image forming section) of each of the first image forming unit and the second image forming unit.

Preferably, the predetermined condition is a number of times each of the first image forming unit and the second image forming unit performs the printing in the single-sided printing.

Accordingly, the image forming units can be made uniform in deterioration progress of the materials of their image forming sections. In addition, since the number of times the sheet-passing image forming unit forms non-color images on sheets in succession is limited, unbalanced abrasion of the blades and the like can be avoided.

Preferably, the control section performs the printing in accordance with print command information which indicates performing the printing on a certain number of sheets, and when a command to perform the single-sided printing and a command to perform the double-sided printing exist in the print command information, and the single-sided printing is performed, the control section does not switch the sheet-passing image forming unit to the monochrome mode even if the sheet-passing image forming unit is set to the color mode.

Accordingly, the image forming apparatus can prevent the productivity from decreasing and the deterioration of materials thereof from progressing, which occur when the sheet-passing image forming unit is switched from/to the color mode to/from the monochrome mode a plurality of times.

The present U.S. patent application claims priority to Japanese Patent Applications No. 2010-226195 filed on Oct. 6, 2010, and No. 2010-258424 filed on Nov. 19, 2010, under the Paris Convention for the Protection of Industrial Property, and these Japanese Patent Applications are grounds for correction of mistakes in translation of the present U.S. patent application when necessary.

What is claimed is:

1. A tandem-type image forming system performing single-sided printing and double-sided printing on a sheet, the image forming system comprising:

a first image forming apparatus; and a second image forming apparatus connected with the first image forming apparatus in series;

wherein when the single-sided printing is performed, one of the first image forming apparatus and the second image forming apparatus performs printing on a sheet;

wherein when the double-sided printing is performed, both of the first image forming apparatus and the second image forming apparatus perform the printing on a sheet;

wherein the image forming system further comprises a control section which controls a sheet-passing image forming apparatus which is one of the first image forming apparatus and the second image forming apparatus and which does not perform the printing but performs sheet-passing in the single-sided printing;

wherein when the single-sided printing is performed, the control section rotates a resist roller and a fixing roller of the sheet-passing image forming apparatus, and controls a component of an image forming section of the sheet-passing image forming apparatus based on a sheet condition, the image forming section being disposed on a sheet carry path between the resist roller and the fixing roller;

wherein the sheet condition includes a sheet length in a sub-scanning direction, a sheet basis weight, and a sheet curl amount;

wherein the sheet-passing image forming apparatus is a color image forming apparatus; and wherein the component of the image forming section of the sheet-passing image forming apparatus includes yellow, magenta, cyan, and black photosensitive drums, an intermediate transfer belt, and a secondary transfer roller.

2. The tandem-type image forming system according to claim 1, wherein when the sheet length in the sub-scanning direction is equal to or longer than a distance between the resist roller and the fixing roller plus a predetermined distance, and the sheet basis weight is equal to or more than a predetermined amount, the control section separates the yellow, magenta, cyan, and black photosensitive drums and the intermediate transfer belt from each other, and separates the intermediate transfer belt and the secondary transfer roller from each other.

3. The tandem-type image forming system according to claim 1, wherein when the sheet curl amount is less than a predetermined amount, the control section separates the yellow, magenta, cyan, and black photosensitive drums and the intermediate transfer belt from each other, and separates the intermediate transfer belt and the secondary transfer roller from each other.

4. The tandem-type image forming system according to claim 1, wherein the control section rotates the secondary transfer roller.

5. The tandem-type image forming system according to claim 4, wherein the control section separates the secondary transfer roller and a blade which removes an adhesive substance adhering to the secondary transfer roller from each other.

6. The tandem-type image forming system according to claim 1, wherein when the sheet length in the sub-scanning direction is shorter than a distance between the resist roller and the fixing roller plus a predetermined distance, or when the sheet length is equal to or longer than the distance between the resist roller and the fixing roller plus the predetermined distance, and the sheet basis weight is less than a predetermined amount, the control section separates the yellow, magenta, cyan, and black photosensitive drums and the intermediate transfer belt from each other, brings the intermediate transfer belt and the secondary transfer roller into contact with each other, and rotates the intermediate transfer belt and the secondary transfer roller.

7. The tandem-type image forming system according to claim 6, wherein the control section separates the intermediate transfer belt and a blade which removes an adhesive substance adhering to the intermediate transfer belt from each other.

8. The tandem-type image forming system according to claim 1, wherein when the sheet curl amount is equal to or more than a predetermined amount, the control section separates the yellow, magenta, cyan, and black photosensitive drums and the intermediate transfer belt from each other, brings the intermediate transfer belt and the secondary transfer roller into contact with each other, and rotates the intermediate transfer belt and the secondary transfer roller.

9. A tandem-type image forming system performing single-sided printing and double-sided printing on a sheet, the image forming system comprising:

a first image forming apparatus; and a second image forming apparatus connected with the first image forming apparatus in series;

wherein when the single-sided printing is performed, one of the first image forming apparatus and the second image forming apparatus performs printing on a sheet;

wherein when the double-sided printing is performed, both of the first image forming apparatus and the second image forming apparatus perform the printing on a sheet:

wherein the image forming system further comprises a control section which controls a sheet-passing image forming apparatus which is one of the first image forming apparatus and the second image forming apparatus and which does not perform the printing but performs sheet-passing in the single-sided printing;

wherein when the single-sided printing is performed, the control section rotates a resist roller and a fixing roller of the sheet-passing image forming apparatus, and controls a component of an image forming section of the sheet-passing image forming apparatus based on a sheet condition, the image forming section being disposed on a sheet carry path between the resist roller and the fixing roller;

wherein the sheet condition includes a sheet length in a sub-scanning direction, a sheet basis weight, and a sheet curl amount;

wherein the sheet-passing image forming apparatus is a monochrome image forming apparatus; and wherein the component of the image forming section of the sheet-passing image forming apparatus includes a photosensitive drum and a transfer-separation device.

10. The tandem-type image forming system according to claim 9, wherein when the sheet length in the sub-scanning direction is equal to or longer than a distance between the resist roller and the fixing roller plus a predetermined distance, and the sheet basis weight is equal to or more than a predetermined amount, the control section does not rotate but stops the photosensitive drum, and turns off the transfer-separation device.

11. The tandem-type image forming system according to claim 9, wherein when the sheet curl amount is less than a predetermined amount, the control section does not rotate but stops the photosensitive drum, and turns off the transfer-separation device.

12. The tandem-type image forming system according to claim 9, wherein when the sheet length in the sub-scanning direction is shorter than a distance between the resist roller and the fixing roller plus a predetermined distance, or when the sheet length is equal to or longer than the distance between the resist roller and the fixing roller plus the predetermined distance, and the sheet basis weight is less than a predetermined amount, the control section rotates the photosensitive drum, and turns on the transfer-separation device.

13. The tandem-type image forming system according to claim 9, wherein when the sheet curl amount is equal to or more than a predetermined amount, the control section rotates the photosensitive drum, and turns on the transfer-separation device.

14. A tandem-type image forming system performing single-sided printing and double-sided printing on a sheet, the image forming system comprising:

a first image forming apparatus; and a second image forming apparatus connected with the first image forming apparatus in series;

wherein when the single-sided printing is performed, one of the first image forming apparatus and the second image forming apparatus performs printing on a sheet;

wherein when the double-sided printing is performed, both of the first image forming apparatus and the second image forming apparatus perform the printing on a sheet:

wherein the image forming system further comprises a control section which controls a sheet-passing image forming apparatus which is one of the first image forming apparatus and the second image forming apparatus and which does not perform the printing but performs sheet-passing in the single-sided printing;

wherein each of the first image forming apparatus and the second image forming apparatus can be switched to a color mode in which color printing is performed on the sheet and to a monochrome mode in which monochrome printing is performed on the sheet so as to be set to either the color mode or the monochrome mode; and wherein when the single-sided printing is performed, and the sheet-passing image forming apparatus is set to the color mode, the control section switches the sheet-passing image forming apparatus to the monochrome mode so as to set the sheet-passing image forming apparatus to the monochrome mode.

15. The tandem-type image forming system according to claim 14, wherein the control section switches the sheet-passing image forming apparatus and a printing image forming apparatus based on a predetermined condition, the printing image forming apparatus being one of the first image forming apparatus and the second image forming apparatus and performing the printing in the single-sided printing.

16. The tandem-type image forming system according to claim 15, wherein each of the first image forming apparatus and the second image forming apparatus includes an image forming section which forms an image on the sheet, and the predetermined condition is a deterioration degree of a material of the image forming section of each of the first image forming apparatus and the second image forming apparatus.

17. The tandem-type image forming system according to claim 15, wherein the predetermined condition is a number of times each of the first image forming apparatus and the second image forming apparatus performs the printing in the single-sided printing.

18. The tandem-type image forming system according to claim 15, wherein the control section performs the printing in accordance with print command information which indicates performing the printing on a certain number of sheets, and when a command to perform the single-sided printing and a command to perform the double-sided printing exist in the print command information, and the single-sided printing is performed, the control section does not switch the sheet-passing image forming apparatus to the monochrome mode even if the sheet-passing image forming apparatus is set to the color mode.

19. A tandem-type image forming apparatus performing single-sided printing and double-sided printing on a sheet, the image forming apparatus comprising:

a first image forming unit; and a second image forming unit connected with the first image forming unit in series;

wherein when the single-sided printing is performed, one of the first image forming unit and the second image forming unit performs printing on a sheet;

wherein when the double-sided printing is performed, both of the first image forming unit and the second image forming unit perform the printing on a sheet;

wherein the image forming apparatus further comprises a control section which controls a sheet-passing image forming unit which is one of the first image forming unit and the second image forming unit and which does not perform the printing but performs sheet-passing in the single-sided printing;

wherein when the single-sided printing is performed, the control section rotates a resist roller and a fixing roller of the sheet-passing image forming unit, and controls a component of an image forming section of the sheet-passing image forming unit based on a sheet condition, the image forming section being disposed on a sheet carry path between the resist roller and the fixing roller;

wherein the sheet condition includes a sheet length in a sub-scanning direction, a sheet basis weight, and a sheet curl amount;

wherein the sheet-passing image forming unit is a color image forming unit; and wherein the component of the image forming section of the sheet-passing image forming unit includes yellow, magenta, cyan, and black photosensitive drums, an intermediate transfer belt, and a secondary transfer roller.

20. The tandem-type image forming apparatus according to claim 19, wherein when the sheet length in the sub-scanning direction is equal to or longer than a distance between the resist roller and the fixing roller plus a predetermined distance, and the sheet basis weight is equal to or more than a predetermined amount, the control section separates the yellow, magenta, cyan, and black photosensitive drums and the intermediate transfer belt from each other, and separates the intermediate transfer belt and the secondary transfer roller from each other.

21. The tandem-type image forming apparatus according to claim 19, wherein when the sheet curl amount is less than a predetermined amount, the control section separates the yellow, magenta, cyan, and black photosensitive drums and the intermediate transfer belt from each other, and separates the intermediate transfer belt and the secondary transfer roller from each other.

22. The tandem-type image forming apparatus according to claim 19, wherein the control section rotates the secondary transfer roller.

23. The tandem-type image forming apparatus according to claim 22, wherein the control section separates the secondary transfer roller and a blade which removes an adhesive substance adhering to the secondary transfer roller from each other.

24. The tandem-type image forming apparatus according to claim 19, wherein when the sheet length in the sub-scanning direction is shorter than a distance between the resist roller and the fixing roller plus a predetermined distance, or when the sheet length is equal to or longer than the distance between the resist roller and the fixing roller plus the predetermined distance, and the sheet basis weight is less than a predetermined amount, the control section separates the yellow, magenta, cyan, and black photosensitive drums and the intermediate transfer belt from each other, brings the intermediate transfer belt and the secondary transfer roller into contact with each other, and rotates the intermediate transfer belt and the secondary transfer roller.

25. The tandem-type image forming apparatus according to claim 24, wherein the control section separates the intermediate transfer belt and a blade which removes an adhesive substance adhering to the intermediate transfer belt from each other.

26. The tandem-type image forming apparatus according to claim 19, wherein when the sheet curl amount is equal to or more than a predetermined amount, the control section separates the yellow, magenta, cyan, and black photosensitive drums and the intermediate transfer belt from each other, brings the intermediate transfer belt and the secondary transfer roller into contact with each other, and rotates the intermediate transfer belt and the secondary transfer roller.

27. A tandem-type image forming apparatus performing single-sided printing and double-sided printing on a sheet, the image forming apparatus comprising:

a first image forming unit; and a second image forming unit connected with the first image forming unit in series;

wherein when the single-sided printing is performed, one of the first image forming unit and the second image forming unit performs printing on a sheet;

wherein when the double-sided printing is performed, both of the first image forming unit and the second image forming unit perform the printing on a sheet;

wherein the image forming apparatus further comprises a control section which controls a sheet-passing image forming unit which is one of the first image forming unit and the second image forming unit and which does not perform the printing but performs sheet-passing in the single-sided printing;

wherein when the single-sided printing is performed, the control section rotates a resist roller and a fixing roller of the sheet-passing image forming unit, and controls a component of an image forming section of the sheet-passing image forming unit based on a sheet condition, the image forming section being disposed on a sheet carry path between the resist roller and the fixing roller;

wherein the sheet condition includes a sheet length in a sub-scanning direction, a sheet basis weight, and a sheet curl amount;

wherein the sheet-passing image forming unit is a monochrome image forming unit; and wherein the component of the image forming section of the sheet-passing image forming unit includes a photosensitive drum and a transfer-separation device.

28. The tandem-type image forming apparatus according to claim 27, wherein when the sheet length in the sub-scanning direction is equal to or longer than a distance between the resist roller and the fixing roller plus a predetermined distance, and the sheet basis weight is equal to or more than a predetermined amount, the control section does not rotate but stops the photosensitive drum, and turns off the transfer-separation device.

29. The tandem-type image forming apparatus according to claim 27, wherein when the sheet curl amount is less than a predetermined amount, the control section does not rotate but stops the photosensitive drum, and turns off the transfer-separation device.

30. The tandem-type image forming apparatus according to claim 27, wherein when the sheet length in the sub-scanning direction is shorter than a distance between the resist roller and the fixing roller plus a predetermined distance, or when the sheet length is equal to or longer than the distance between the resist roller and the fixing roller plus the predetermined distance, and the sheet basis weight is less than a predetermined amount, the control section rotates the photosensitive drum, and turns on the transfer-separation device.

31. The tandem-type image forming apparatus according to claim 27, wherein when the sheet curl amount is equal to or more than a predetermined amount, the control section rotates the photosensitive drum, and turns on the transfer-separation device.

32. A tandem-type image forming apparatus performing single-sided printing and double-sided printing on a sheet, the image forming apparatus comprising:

a first image forming unit; and a second image forming unit connected with the first image forming unit in series;

wherein when the single-sided printing is performed, one of the first image forming unit and the second image forming unit performs printing on a sheet;

wherein when the double-sided printing is performed, both of the first image forming unit and the second image forming unit perform the printing on a sheet;

wherein the image forming apparatus further comprises a control section which controls a sheet-passing image forming unit which is one of the first image forming unit and the second image forming unit and which does not perform the printing but performs sheet-passing in the single-sided printing;

wherein each of the first image forming unit and the second image forming unit can be switched to a color mode in which color printing is performed on the sheet and to a monochrome mode in which monochrome printing is performed on the sheet so as to be set to either the color mode or the monochrome mode; and wherein when the single-sided printing is performed, and the sheet-passing image forming unit is set to the color mode, the control section switches the sheet-passing image forming unit to the monochrome mode so as to set the sheet-passing image forming unit to the monochrome mode.

33. The tandem-type image forming apparatus according to claim 32, wherein the control section switches the sheet-passing image forming unit and a printing image forming unit based on a predetermined condition, the printing image forming unit being one of the first image forming unit and the second image forming unit and performing the printing in the single-sided printing.

34. The tandem-type image forming apparatus according to claim 33, wherein each of the first image forming unit and the second image forming unit includes an image forming section which forms an image on the sheet, and the predetermined condition is a deterioration degree of a material of the image forming section of each of the first image forming unit and the second image forming unit.

35. The tandem-type image forming apparatus according to claim 33, wherein the predetermined condition is a number of times each of the first image forming unit and the second image forming unit performs the printing in the single-sided printing.

36. The tandem-type image forming apparatus according to claim 33, wherein the control section performs the printing in accordance with print command information which indicates performing the printing on a certain number of sheets, and when a command to perform the single-sided printing and a command to perform the double-sided printing exist in the print command information, and the single-sided printing is performed, the control section does not switch the sheet-passing image forming unit to the monochrome mode even if the sheet-passing image forming unit is set to the color mode.

* * * * *